US011304515B2

(12) United States Patent
Ghrir

(10) Patent No.: US 11,304,515 B2
(45) Date of Patent: Apr. 19, 2022

(54) MERCHANDISE DISPLAYING, STORING AND DISPENSING SYSTEM

(71) Applicant: Haitham Ghrir, San Bernadino, CA (US)

(72) Inventor: Haitham Ghrir, San Bernadino, CA (US)

( * ) Notice: Subject to any disclaimer, the term of this patent is extended or adjusted under 35 U.S.C. 154(b) by 0 days.

(21) Appl. No.: 16/990,159

(22) Filed: Aug. 11, 2020

(65) Prior Publication Data

US 2022/0047073 A1 Feb. 17, 2022

(51) Int. Cl.
*A47F 3/02* (2006.01)
*A47B 73/00* (2006.01)
*A47F 3/00* (2006.01)

(52) U.S. Cl.
CPC ..... *A47B 73/006* (2013.01); *A47F 3/004* (2013.01); *A47F 3/02* (2013.01)

(58) Field of Classification Search
CPC ..... A47B 73/006; A47F 3/02; A47F 3/004
USPC ..... 312/107, 42, 71, 72
See application file for complete search history.

(56) References Cited

U.S. PATENT DOCUMENTS 1,668,171 A 5/1928 Pratt
1,692,463 A * 11/1928 Merrin ..... A47K 10/427 221/34
2,102,982 A 12/1937 Taylor
2,409,117 A * 10/1946 Fero ..... A47F 3/005 312/107
3,552,817 A * 1/1971 Marcolongo ..... A47B 87/02 312/107
3,563,624 A * 2/1971 Stice ..... A47B 87/00 312/111
3,674,175 A 7/1972 Jaquish
3,744,866 A * 7/1973 Cook ..... A47F 1/08 312/42
3,795,345 A 3/1974 Baxendale
4,093,076 A 6/1978 Newton
4,270,662 A 6/1981 Gonzales
4,485,930 A 12/1984 Savelkouls
4,523,677 A 6/1985 Schurmann
4,795,038 A 1/1989 Johnson
4,942,967 A 7/1990 Schneider
4,961,506 A 10/1990 Lang
4,972,964 A 11/1990 Escalante
4,998,628 A 3/1991 Ross
5,147,119 A * 9/1992 Harris ..... A47F 1/08 211/59.2
5,190,168 A * 3/1993 French ..... A61C 9/0006 211/59.2

(Continued)

*Primary Examiner* — James O Hansen

(57) ABSTRACT

A merchandise displaying, storing and dispensing system (MDSDS) that comprises a modular structure made up of multiple cabinets. The design of each cabinet facilitates the insertion, or placing therein, of items that are typically sold in a retail store establishment. Although the MDSDS can be used for many different items, the MDSDS is optimally designed for use with small liquor bottles. The cabinet do not utilize complicated moving parts, but rather gravity to allow liquor bottles to be displayed or stored, and then dispensed when stored, and then the need arises. The MDSDS offers a convenient space-saving solution to selling items such as small liquor bottles which are often difficult to display and sell. As a result of its modular design the MDSDS can be built to any size/dimension desired or required.

14 Claims, 21 Drawing Sheets

(56) References Cited

U.S. PATENT DOCUMENTS 5,271,515 A 12/1993 Berkheimer
5,678,701 A 10/1997 Anderson
6,012,582 A * 1/2000 Haygeman ..... B65D 5/001 206/503
6,026,958 A 2/2000 Kelly et al.
6,227,386 B1 * 5/2001 Close ..... A47F 1/125 211/59.3
6,615,996 B1 9/2003 Ivey
7,690,518 B2 4/2010 Fincher et al.
7,903,860 B2 3/2011 Meri
7,908,365 B2 4/2011 White et al.
8,028,855 B2 10/2011 White et al.
8,033,402 B1 10/2011 Bevis
8,047,400 B1 11/2011 Luberto et al.
8,079,478 B2 12/2011 Short et al.
D711,671 S 8/2014 Arriaga
9,149,135 B2 10/2015 Dovell
9,289,062 B1 3/2016 Posa
9,586,803 B1 3/2017 Snyker
9,781,999 B2 10/2017 McCain
10,004,330 B1 6/2018 Kasza
10,004,350 B1 6/2018 Lin
10,010,072 B2 7/2018 Somers et al.
10,064,510 B1 10/2018 Yablon
10,441,075 B2 10/2019 Kasza et al.
2004/0020877 A1 2/2004 Boron
2004/0263031 A1 * 12/2004 Irizarry ..... A47B 87/0284 312/330.1
2008/0012454 A1 * 1/2008 Kim ..... A47B 87/0292 312/107
2008/0251655 A1 10/2008 Housley
2009/0308885 A1 12/2009 Sainato et al.
2010/0012807 A1 1/2010 Perman
2010/0181273 A1 7/2010 Nagel
2012/0036751 A1 2/2012 Wang et al.
2012/0223090 A1 9/2012 Thomas et al.
2014/0091685 A1 * 4/2014 Greenwood ..... A47B 73/00 312/72

* cited by examiner

MERCHANDISE DISPLAYING, STORING AND DISPENSING SYSTEM

TECHNICAL FIELD

The invention generally pertains to retail merchandise assemblies, and more particularly to a merchandise displaying, storing and dispensing system.

BACKGROUND ART

There are many ways that consumers purchase merchandise and products. While on-line shopping and purchasing has become one of the most popular methods, for certain merchandise, a single item and products it is easier, convenient and preferable to purchase from a retail location (gas station, convenience store, 7-11 store, markets, shops, etc.) such as candy bar, gum, energy drinks, vitamin bottle, medicine bottle, nail polish, small jar of can of spices or air freshener, also there are certain products are age restricted such as pack of cigarettes, a tin of tobacco and a shot bottles of liquor.

The common factor most of these stores share is that they are all smaller than a supermarket and have a limited amount of space to store and display merchandise. As a result, it is normal to see products displayed on or adjacent to a counter, even the main check-out counter. Products such as hard alcohol and tobacco are usually displayed behind the counter. To purchase one of these products, customers will ask or tell the cashier what they want, or point to the product. This is usually not a problem when the customers know exactly what they want, but can become difficult if the customers wish to look and decide which product they want. This problem is exacerbated for products that have more than 100 different brand names such as shot bottles of liquor which are (50 ml) size bottles. An additional problem for those bottles is due to their sizes and the requirement of maintaining them inaccessible to customers under the age of 21, it is often difficult to find a location where the over 21 customers can easily see the bottles and allow the cashier to quickly and easily grab whichever bottle the customer has chosen.

What is needed is a convenient means of displaying such items (shot bottles) while providing easy accessibility when needed. Optimally, there would be a single location where smalls bottles or other items could also be stored, in addition to providing display and access. By placing small bottles or other items into a cabinet in which the bottles could be displayed, stored and dispensed, and placing the cabinet on a counter or similar location, would provide a solution to many of the problems associated with this type of merchandise.

A search of the prior art did not disclose any literature or patents that read directly on the claims of the instant invention. However, the following U.S. patents are considered related:

| PAT. NO. | INVENTOR | ISSUED |
|---|---|---|
| 4,037,756 | Jaquish | Sep. 26, 1977 |
| 4,396,237 | Henry | Aug. 2, 1983 |
| 6,715,621 | Boron | Apr. 6, 2004 |

The U.S. Pat. No. 4,037,756 patent discloses a display-dispenser rack for maintaining differently sized articles for dispensing. The rack comprises a plurality of vertically extending open front compartments. A flange extends partially over the front of the compartment to retain an article in the compartment exposed for view through a space adjacent the flange. The flange does not extend to the bottom of the compartment leaving an opening permitting withdrawal of the lowermost articles in the compartment. A positionable rear spacer member with a spring leg is provided for positioning within the compartment, permitting variation of the depth of the compartment from front to rear to accommodate differently sized articles.

The U.S. Pat. No. 4,396,237 patent discloses a cabinet for displaying and dispensing vertical stacks of small packages and is adapted to be mounted over a store's counter. The shopper's side of the cabinet is transparent so that the shopper can see the merchandise. The clerk's side of the cabinet has an opening which permits loading of packages onto the stacks and a lower slot which permits loading of packages onto the stacks and a lower slot which permits withdrawing one package at a time from the bottom of any selected stack. A similar cabinet is on the rear side of the one just described, so that packages in the rear one can be seen through the one in front and allowing withdraws of packages from both.

The U.S. Pat. No. 6,715,621 patent discloses a module for supporting and merchandising product containers. The module includes at least one elongated product channel defined by a pair of side walls and a product supporting floor extending therebetween. Each product channel has at least one front member above the floor and partially bridging the product channel side walls. The front member includes a first wall extending from one of the side walls and a second wall extending from the other side walls. The first and second front wall allow a product container within a product channel to be pulled therethrough.

For background purposes and indicative of the art to which the invention relates, reference may be made to the following remaining patents found in the patent search.

| PAT. NO. | INVENTOR | ISSUED |
|---|---|---|
| D711,671 | Arriaga | Aug. 26, 2014 |
| 1,668,171 | Pratt | May 1, 1928 |
| 2,102,982 | Taylor | Dec. 21, 1937 |
| 3,795,345 | Baxendale | Mar. 5, 1974 |
| 4,093,076 | Newton | Jun. 6, 1978 |
| 4,270,662 | Gonzales | Jun. 2, 1981 |
| 4,485,930 | Savelkouls | Dec. 4, 1982 |
| 4,523,677 | Schurmann | Jun. 18, 1985 |
| 4,795,038 | Johnson | Jan. 3, 1989 |
| 4,942,967 | Schneider | Jul. 24, 1990 |
| 4,961,506 | Lang | Oct. 9, 1990 |
| 4,972,964 | Escalante | Nov. 27, 1990 |
| 4,998,628 | Ross | Mar. 12, 1991 |
| 5,271,515 | Berkheimer et al | Dec. 21, 1993 |
| 5,678,701 | Anderson | Oct. 21, 1997 |
| 6,026,958 | Kelly et al | Feb. 22, 2000 |
| 6,615,996 | Ivey | Sep. 9, 2013 |
| 7,690,518 | Fincher et al | Apr. 6, 2010 |
| 7,913,860 | Merl | Mar. 29, 2011 |
| 7,918,365 | White et al | Apr. 5, 2011 |
| 8,028,855 | White et al | Oct. 4, 2011 |
| 8,033,402 | Bevis | Oct. 11, 2011 |
| 8,047,400 | Luberto et al | Nov. 1, 2011 |
| 8,079,478 | Short et al | Dec. 20, 2011 |
| 9,149,135 | Dovell | Oct. 6, 2015 |
| 9,289,062 | Posa | Mar. 22, 2010 |
| 9,586,803 | Snyker | Mar. 7, 2017 |
| 9,781,999 | McCain | Oct. 10, 2017 |
| 10,004,330 | Kasza | Jun. 26, 2018 |
| 10,004,350 | Lin | Jun. 26, 2018 |
| 10,010,172 | Somers et al | Jul. 3, 2018 |

-continued

| PAT. NO. | INVENTOR | ISSUED |
|---|---|---|
| 10,064,510 | Yablon | Sep. 4, 2018 |
| 10,441,075 | Kasza et al | Oct. 15, 2019 |
| 2004/0020877 | Boron | Feb. 5, 2004 |
| 2008/0251655 | Housley | Oct. 16, 2008 |
| 2009/0308885 | Sainato et al | Dec. 17, 2009 |
| 2010/0012807 | Perman | Jan. 21, 2010 |
| 2010/0181273 | Nagel et al | Jul. 22, 2010 |
| 2012/0036751 | Wang et al | Feb. 16, 2012 |
| 2012/0223090 | Thomas et al | Sep. 6, 2012 |

DISCLOSURE OF THE INVENTION

A merchandise displaying, storing and dispensing system (MDSDS) comprising a modular structure made-up of multiple cabinets of varying types and sizes, depending on the desire and/or requirement of use. All cabinets are designed to display store and dispense merchandise in a retail/store environment. Although many types of merchandise can be used in the MDSDS, and the cabinets can be constructed with any dimensions, the MDSDS is optimally designed for use with small scale, cylindrical shaped containers (bottles, cans, tins, packs). Certain cabinets can be designed for specific items such as shot bottles of liquor (50 ml), also known as airplane bottles.

Examples of cabinet designs include: a first cabinet with slanted shelves that utilize at least one inner bottle retainer (bottles holder, organizer, rack), the bottle retainers can be as many as needed, single row or dual row, the bottles are oriented to be quickly and easily extracted dispensed from the bottle retainers, because of the slanted shelves in this cabinet, the bottles in these retainers are gravity forced forward within each retainer, when a bottle is removed from the front of the retainer, the remaining bottles slide forward. To help with the sliding process and minimize the friction between the base of the retainer and the bottom of these bottles placed in the retainers, a sliding member miter T-bar can be inserted into the base of the retainers to help the bottles to easily slide forward. The sliding member can be many shapes, such as triangular rod (bar) with a smooth sliding edge.

A second cabinet with horizontal shelves that utilizes at least one inner bottle retainer. As with the first cabinet, a number of bottles are placed into the inner bottle retainer which is then placed into the cabinet. The bottles are oriented to be quickly and easily extracted or dispensed from the bottle retainer. There can be as many bottle retainers as needed in a single row or dual row and in this cabinet the retainers can include a pushing or pulling assembly or rod which facilitates the manual pushing or pulling forward of bottles that are in the retainer, included to help pull the rear bottles forward after dispensing the one in the front of the retainer. There are two embodiments disclosed.

A third cabinet has at least one vertical slot with openings at the top and bottom of the slot, the cabinet's upper side wall can be lifted upward to allow access to the cabinets interior channels to refill it. Vertical members within the cabinet create channels in which items are placed and maintained on top of each other through the slot. When an item is removed from the slot's lower opening, the items on top are gravity forced downward.

A fourth cabinet simply uses a rear panel with at least one, and preferably multiple vertical slots, with openings on the top and bottom. The fourth cabinet is typically larger than the other cabinets and is capable of maintaining and dispensing a significant number of different brands of bottles.

Preferably, placed in front of the fourth cabinet (facing the customers) is a fifth cabinet which has multiple tiers on which items such as candy or gum can be placed and accessible to the customers.

For each of the first, second, third and fourth cabinets there is a display that is designed to show a number of items or bottles. For example, a customer can view the bottles and see what brands or types of liquor are available. The display is usually placed on top or front of the cabinets facing the customers. Once a customer has chosen what they want, the store clerk can remove that particular bottle or item from one of the cabinets.

In view of the above disclosure, the primary object of the invention is to provide a merchandise displaying, storing and dispensing system that allows multiple cabinets to be modularly arranged to create a structure in which items such as a small liquor bottles or other products can be displayed and sold in any environment.

In addition to the primary object, it is also an object of the invention to provide a merchandise displaying, storing and dispensing system that:

- is easy to assemble and use,
- can be placed in various locations such as on or near a store counter,
- can be used for a variety of items,
- can be built to any size desired or required,
- is nice and clear display for all items stored within,
- is a secure way to display and sell age-restricted items such as liquor or tobacco,
- is quick and easy refill or restock,
- requires little or no maintenance,
- can be easily transported to and assembled at different locations,
- is space-saving,
- can be custom designed built to any dimensions,
- allows item inventory to be quickly determined, and
- is low cost effect from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
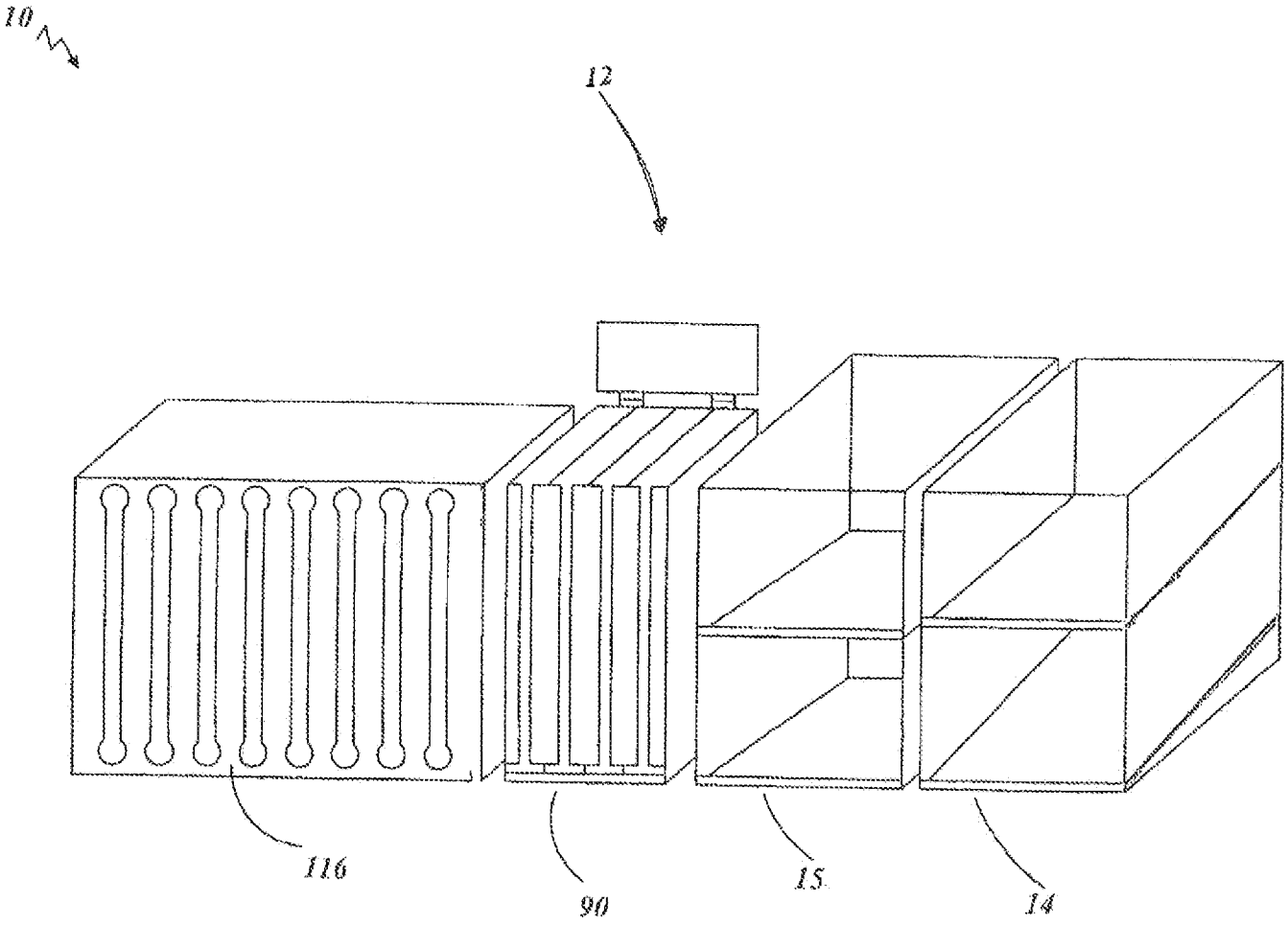
FIG. 1 is an orthographic rear view showing a Merchandise Displaying, Storing and Dispensing System (MDSDS) modular structure comprising four cabinets.

The best mode for carrying out the invention is presented in terms that disclose a preferred embodiment, with multiple configurations, of a merchandise displaying, storing and dispensing system (MDSDS 10). In certain retail establishments, particularly smaller convenience stores there are a variety of items (bottles, cans) sold such as energy drinks, vitamins, medicines and nail polish, also there are certain products that are age restricted such as cigarettes, chewing tobacco and liquor. As a result of the smaller size of many of these stores, coupled with the number/variety of items sold, space is limited.

The problem is that the items must be displayed such that the customers can see what is available while also securing the items from theft and/or being accessed by under-age customers who are not allowed to purchase such items and also maintaining the items at a convenient location for a store clerk to easily grab and sell.

The MDSDS 10 offers a solution to these problems by providing a modular, scalable structure consisting of multiple cabinets, with each cabinet having a unique displaying, storing and dispensing capability for various items. While the MDSDS 10 can be constructed in any size, and to maintain different shaped items, the MDSDS 10 is particularly effective for use with small size bottles such as shot bottles of liquor which typically hold a 50 ml. Therefore, referenced in the text, and shown in the drawings will primarily be small liquor bottle. But, again this is not to infer that the MDSDS 10 is in anyway limited to use only with small liquor bottles.

Figure 2:
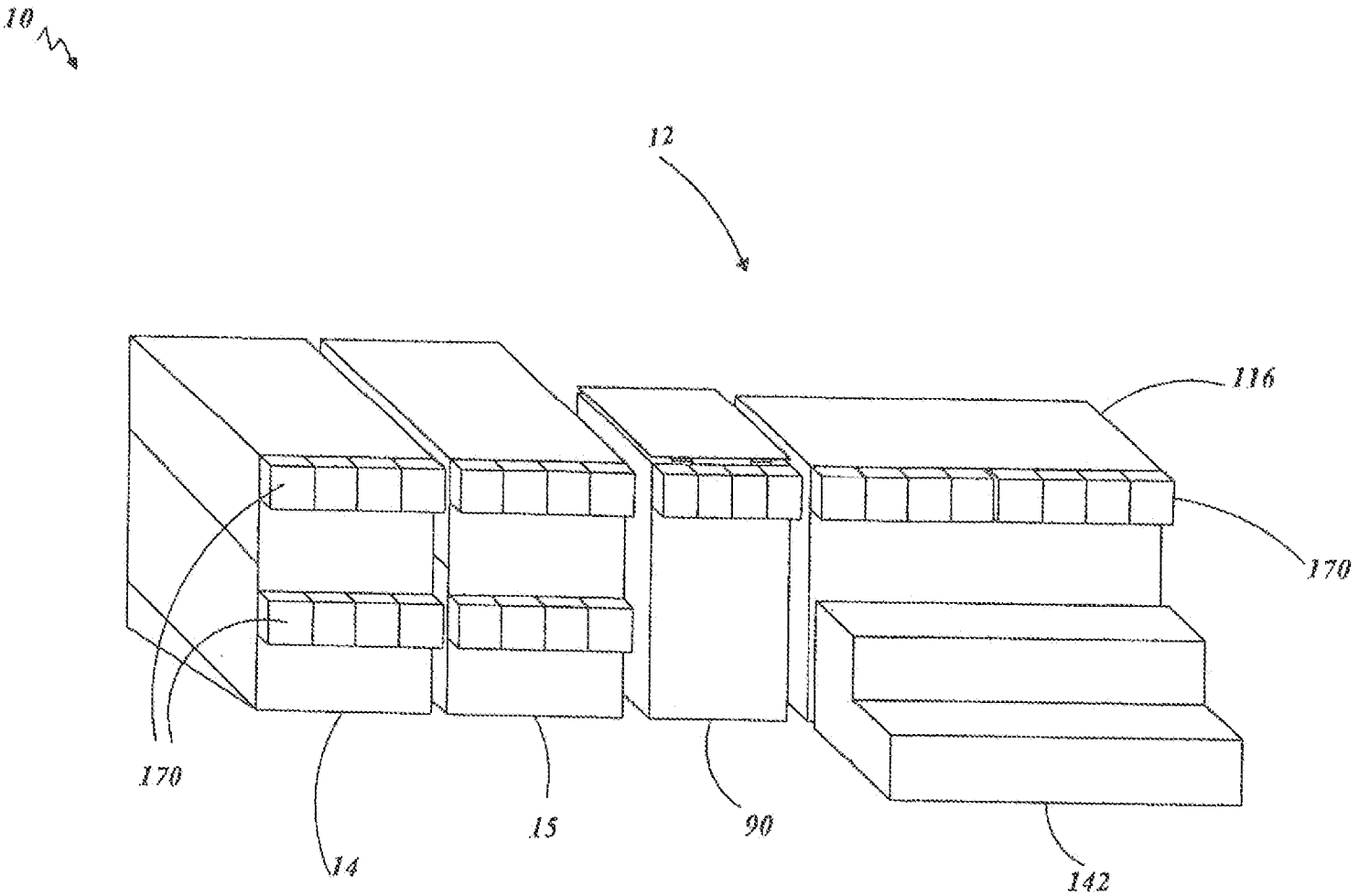
FIG. 2 is an orthographic front view (customer's perspective) showing the MDSDS modular structure comprising five cabinets, and with the addition of display cabinets.

As shown in FIGS. 1 and 2, the MDSDS 10 is comprised of a modular structure 12 comprising of multiple cabinets 14, 15, 90, 116 and 142. The MDSDS 10 can be utilized with only a single cabinet, but the true effective functionality is realized when multiple cabinets are modularly assembled into a combined multi-use structure. The MDSDS 10 can be placed in any location, but it will be most effective when placed on or adjacent a counter where the items within the cabinets can be easily viewed by the customers and easily accessed by a store clerk. By placing the MDSDS 10 on or adjacent the counter, the usable space on the counter is significantly increased.

Figure 3:
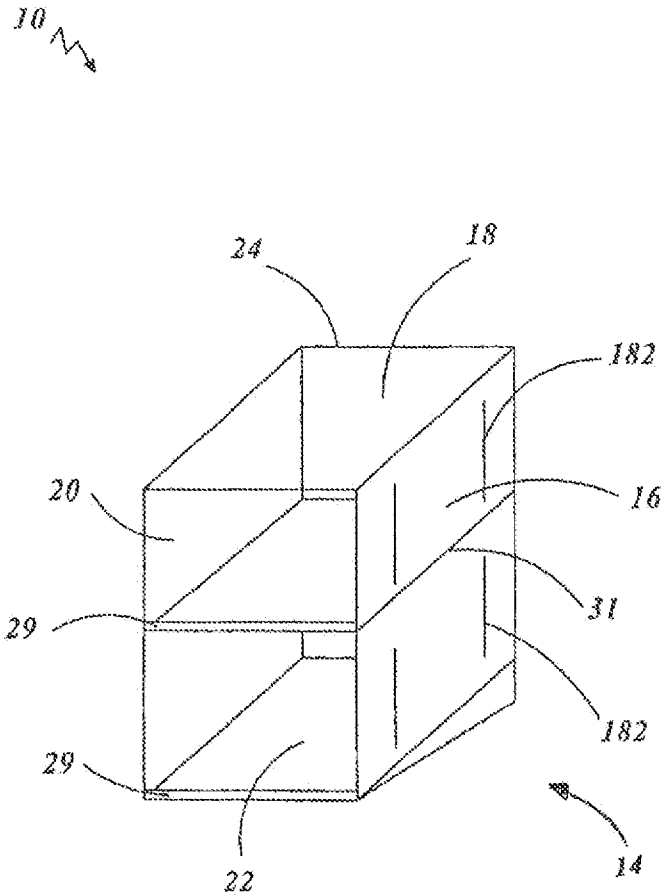
FIG. 3 is an orthographic view showing the MDSDS first cabinet having two levels of slanted shelves.

As previously disclosed, there are multiple configurations of the cabinets which combined create the MDSDS 10. A first cabinet 14, as shown in FIG. 3, is comprised of a first side walls 16, an upper side wall 18, a second side wall 20, a lower side wall 22, a rear panel 24 and cabinet securing means 182 on the side walls 16 and 20. While these elements create what is essentially a square or rectangular structure, other shapes can also be created depending on the desire or requirements of use. Each shelf 31 in the first cabinet 14 is designed to be used with at least one, and preferably multiple, inner bottle retainers. The first cabinet 14 can have at least one slanted shelf 31, with an up-turned lip 29 to keep the inner bottle retainers in place. The slanted shelves 31 separate the interior area into two (or more) levels.

Figure 4:
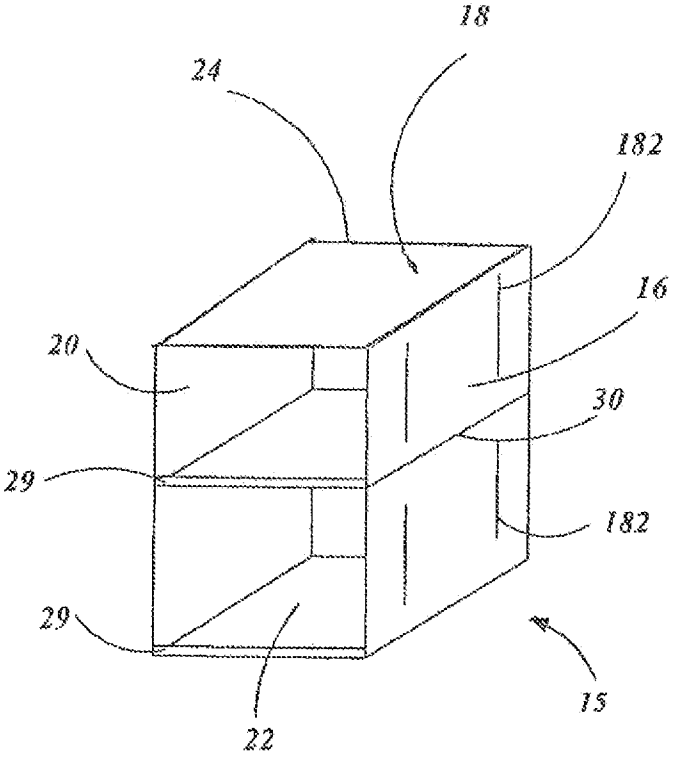
FIG. 4 is an orthographic view showing the MDSDS second cabinet having two levels of horizontal shelves.

A second cabinet 15, as shown in FIG. 4, is comprised of a first side wall 16, an upper side wall 18, a second side wall 20, a lower side wall 22, a rear panel 24 and cabinet securing means 182 on side walls 16 and 20. While these elements create what is essentially square or rectangular structure, other shapes can also be created depending on the desire or requirements of use. The second cabinet 15 can have at least one horizontal shelf 30, with an up-turned lip 29 to keep inner bottle retainers in place. Each shelf in the second cabinet 15 is designed to be used with at least one, and preferably multiple, inner bottle retainers. The horizontal shelves 30 separate the interior area into two (or more) levels.

Figure 10:
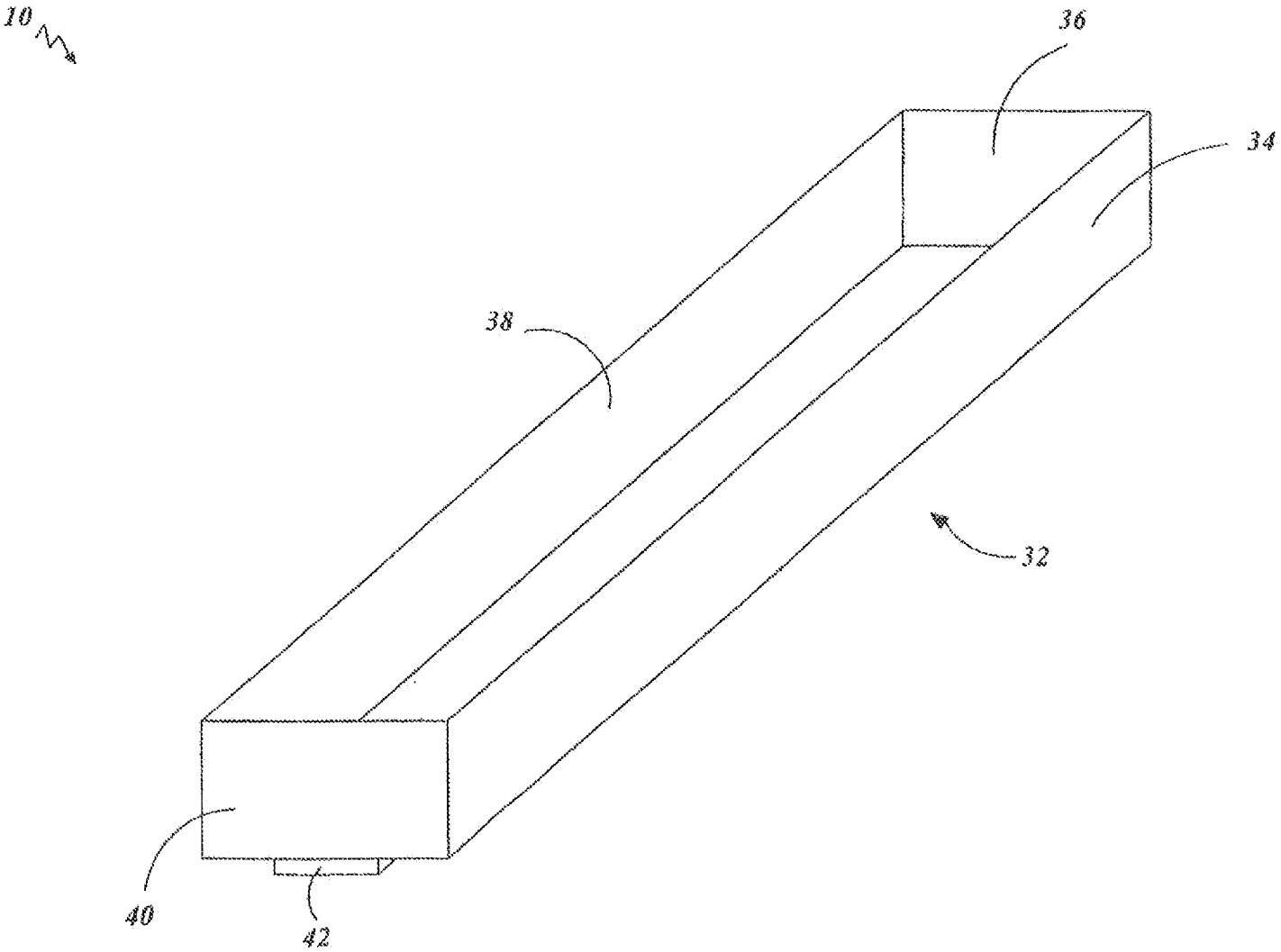
FIG. 10 is an orthographic view showing a single row inner bottle retainer.
Figure 11:
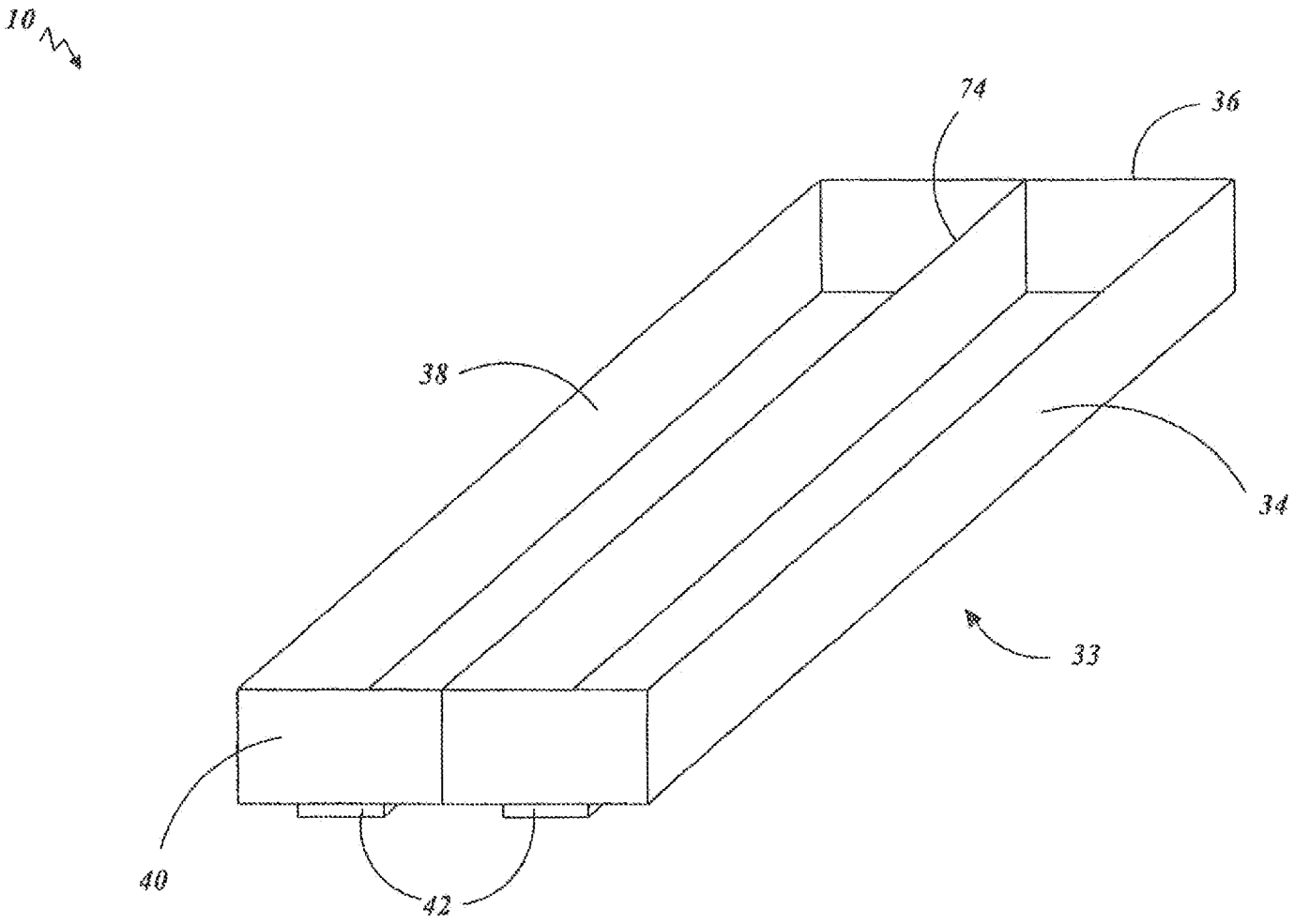
FIG. 11 is an orthographic view showing a dual row inner bottle retainer.
Figure 12:
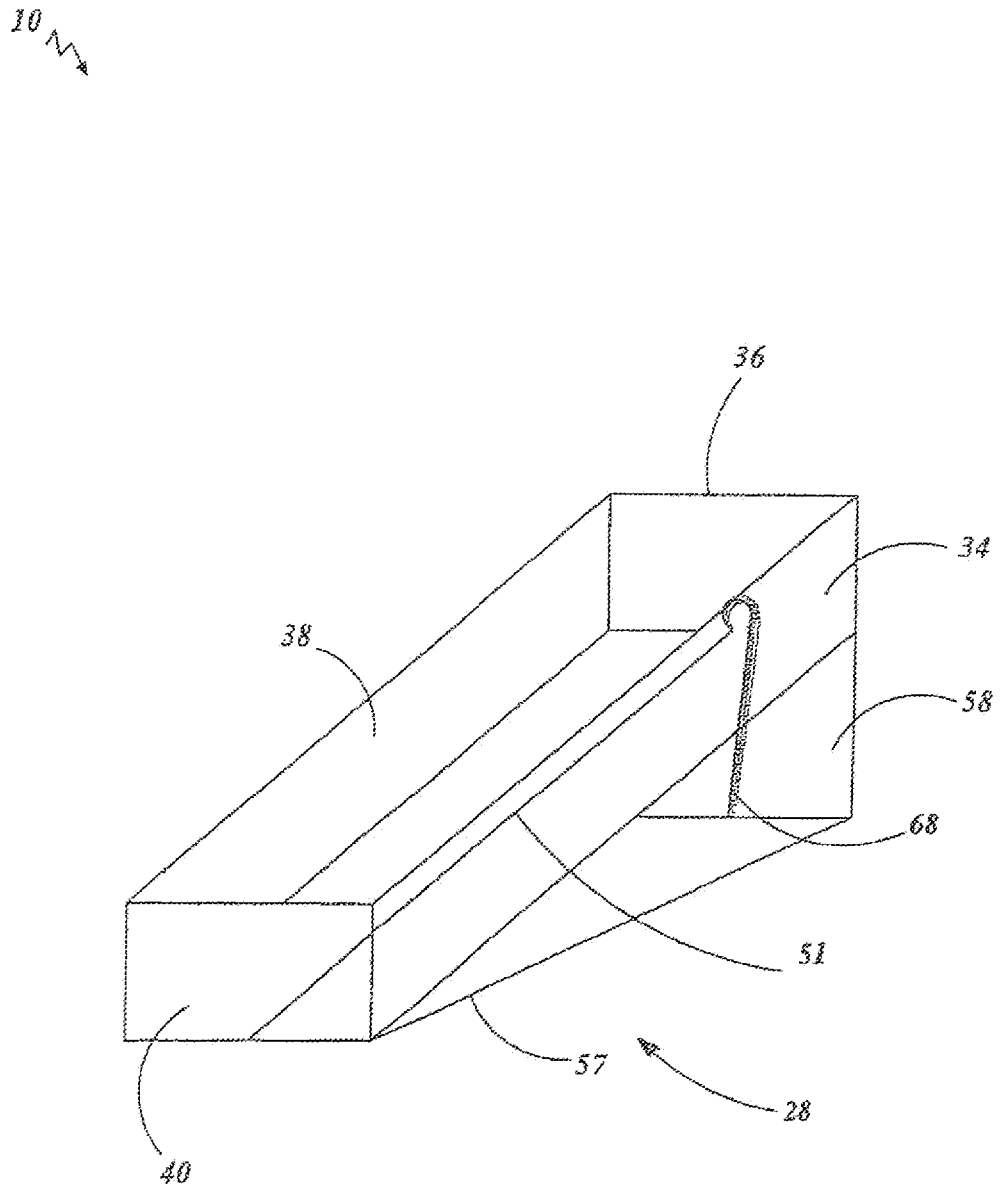
FIG. 12 is an orthographic view showing a single row inner bottle retainer with an angled side wall and sliding member mechanism that allow bottles to be held in a tilted orientation. And the same design with different dimensions can apply for the dual rows inner bottle retainer with the angled side wall and a divider and two sliding members mechanism and design.
Figure 13:
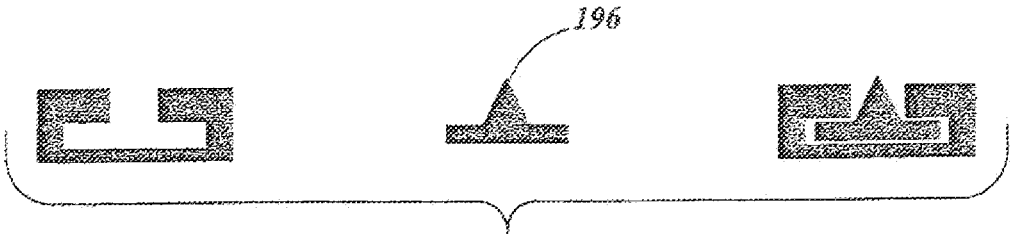
FIG. 13 is an elevational front view showing three sections: an inner bottle retainer base with a miter T-track, a miter T-bar with triangular edge and a base miter T-track with the miter T-bar inserted.
Figure 14:
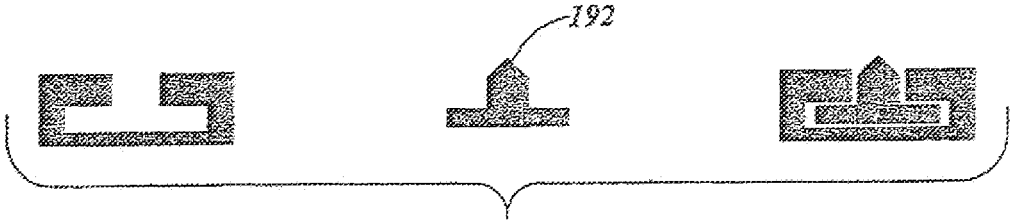
FIG. 14 is an elevational front view showing three sections: an inner bottle retainer base with miter T-track, a miter T-bar with pointed edge, and a base miter T-track with the miter T-bar inserted.
Figure 15:
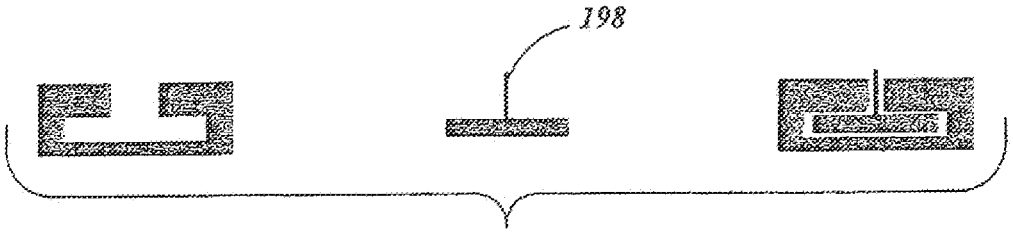
FIG. 15 is an elevational front view showing three sections: an inner bottle retainer base with miter T-track, a miter T-bar with thin line edge, and a base miter T-track with the miter T-bar inserted.
Figure 16:
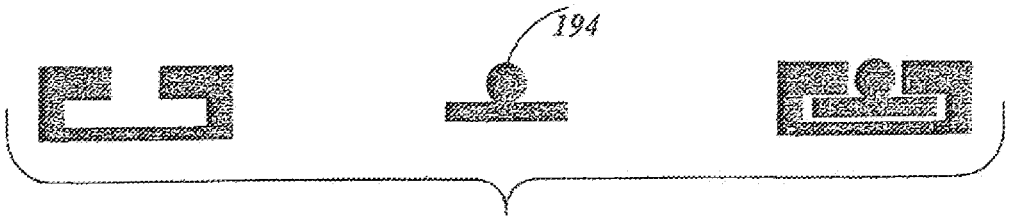
FIG. 16 is an elevational front view showing three sections: an inner bottle retainer base with miter T-track, a miter T-bar with rounded edge, and a base miter T-track with the miter T-bar inserted.

As shown in FIGS. 10, 11 and 12, there are three different types of inner bottle retainer 28, 32, and 33. Each inner bottle retainer has a first side wall 34, a second side wall 36, a third side wall 38 and a fourth side wall 40, producing an elongated rectangular structure.

Figure 8:
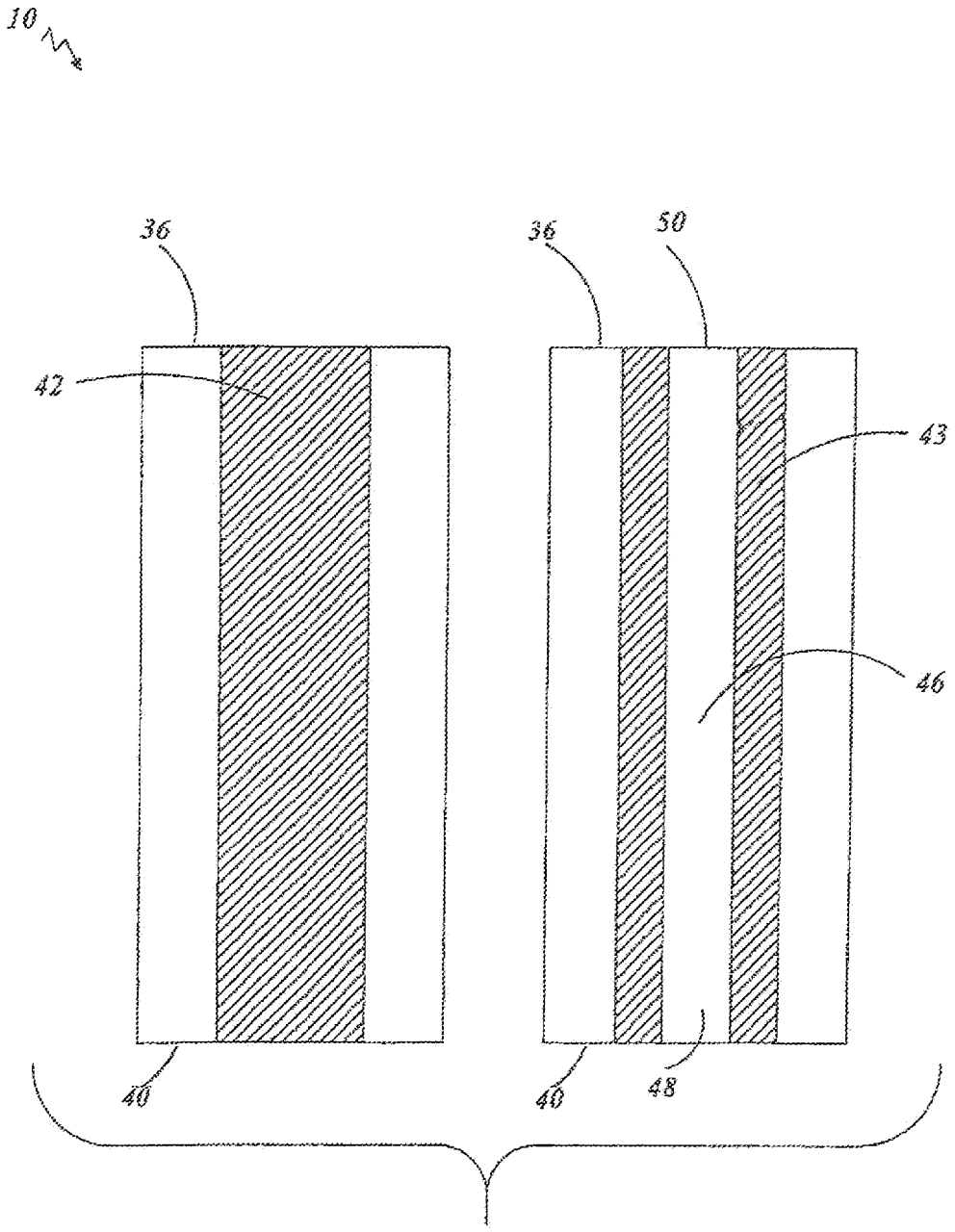
FIG. 8 is a top plan view showing two single row inner bottle retainers, the first retainer has smooth flat base, and the second retainer with a miter T-track in the base.

As shown in FIGS. 8 and 10, is a single row inner bottle retainer 32. Extending from the bottom of the second side wall 36 to the bottom of the fourth side wall 40 of the inner bottle retainer 32 is at least one base (rear panel) 42 without a miter T-track, or at least one base (rear panel) 43 with a miter T-track 46, a front end 48 and a rear end 50.

Figure 17:
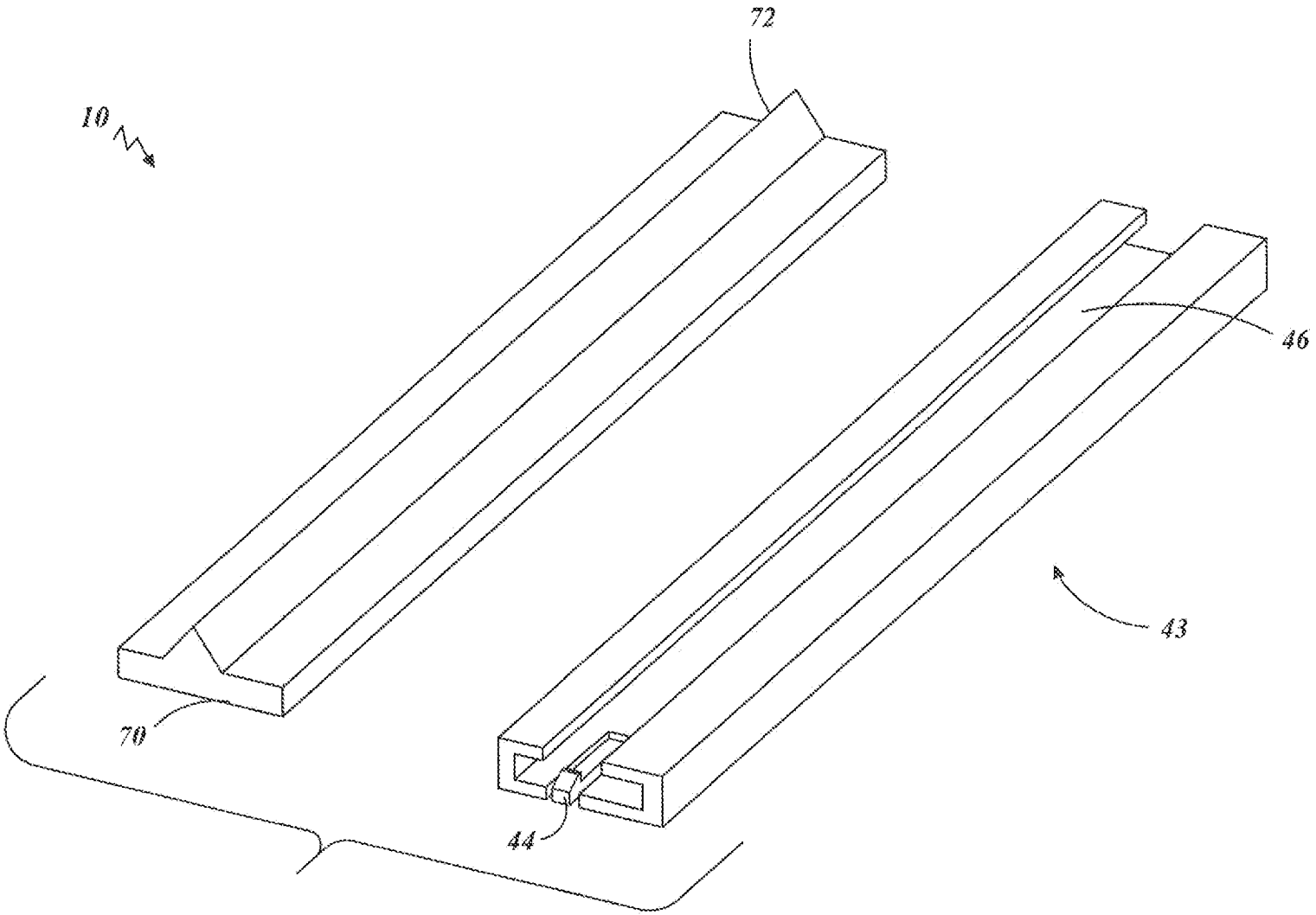
FIG. 17 is an orthographic view showing the miter T-bar with triangular edge and the base with miter T-track of a single row inner bottle retainer that has a locking mechanism to lock the miter T-bar into the base.
Figure 18:
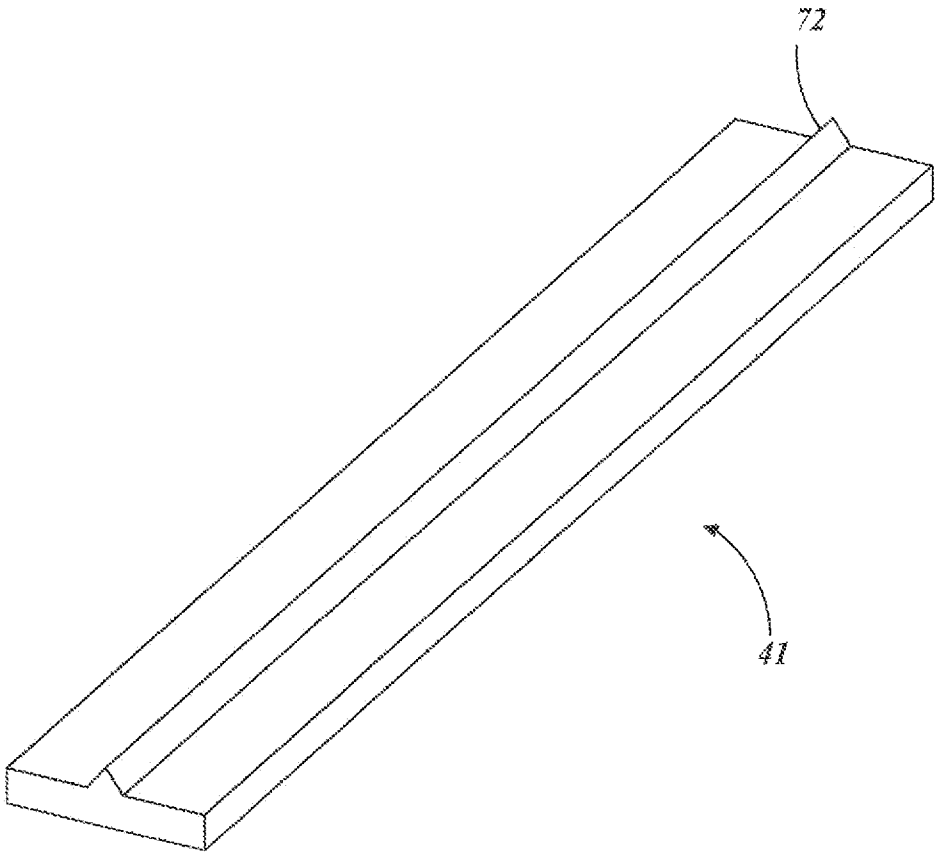
FIG. 18 is an orthographic view showing a base with a triangular sliding bar having smooth edge integral with the base.

As shown in FIG. 17, is a miter T-bar 70 having triangular edge 72, a base 43 with miter T-track 46 and a securing pin 44 to lock the miter T-bar 70 when inserted into the base 43. As shown in FIG. 18, is a base 41 having a triangular sliding bar with a smooth edge 72 integral with the base. The inclusion of the sliding bar with smooth edge 72, or the miter T-bar 70, is one of the important functional aspects of the MDSDS 10. The sliding bar or miter T-bar having a smooth edge reduces the surface area on which a bottle's bottom area slides, thereby reducing friction which can hinder the sliding movement of the bottle, which allows stacked bottles within the inner bottle retainers 32, 33 and 28, to easily and freely slide forward by gravity.

As respectively shown in FIGS. 13, 14, 15 and 16, the sliding bar or miter T-bar, can have a triangular edge 196, pointed edge 192, thin line edge 198 or rounded edge 194. The sliding bar with a smooth edge can be a miter T-bar that is inserted into the base's miter T-track 46. Integral with the bases or side walls, or added to any base and/or side walls of other existing racks.

Figure 9:
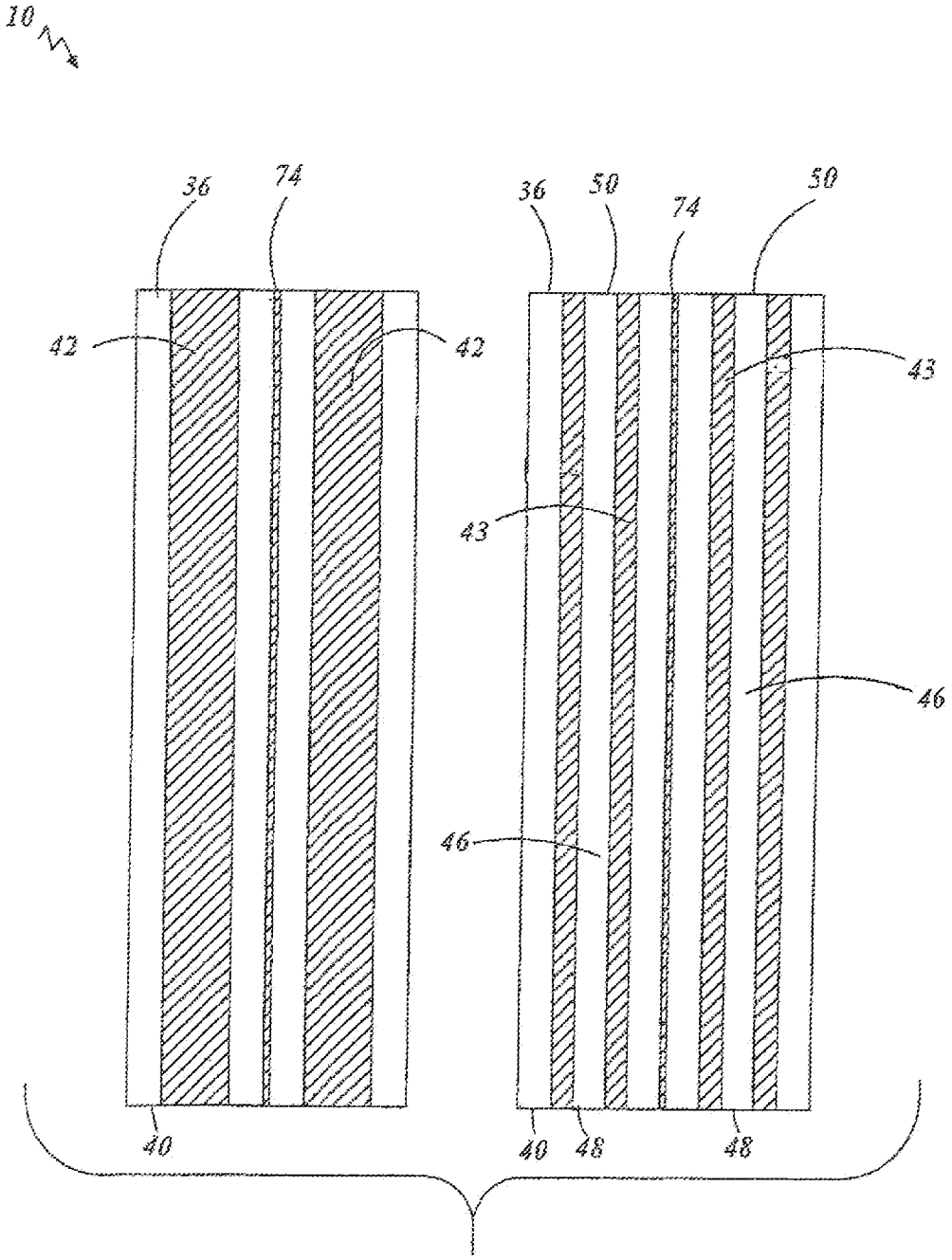
FIG. 9 is a top plan view showing two dual row inner bottle retainers, the first retainer with two smooth flat base, the second retainer with two miter T-tracks in the bases.

As shown in FIGS. 9 and 11, a dual row inner bottle retainer 33 extends from the bottom of the second side wall 36 to the bottom of the fourth side wall 40 of the inner bottle retainer. There are at least two bases (rear panels) 42 without miter T-tracks, or at least two bases (rear panels) 43 with miter T-tracks 46, a front end 48, a rear end 50 and a divider 74.

As shown in FIG. 12, is a single row tilted inner bottle retainer 28 having an angled side wall 58 with a slot 68, an angled base 57 and a sliding rod 51 that functions as a tilting mechanism.

Figure 24:
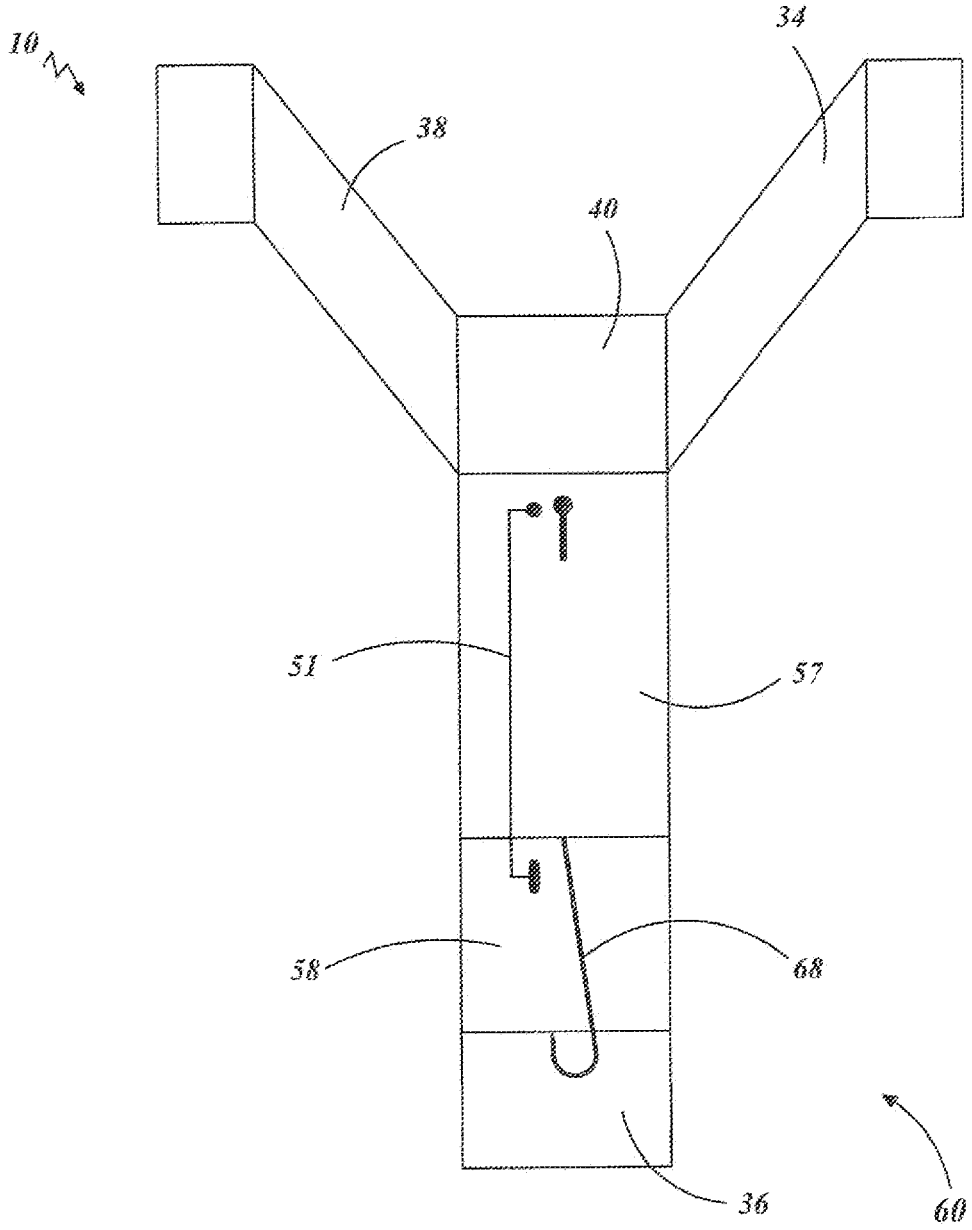
FIG. 24 is a net drawing showing the single row inner bottle retainer as a unitary, one-piece assembly that can be folded into the shape of the single row inner bottle retainer with an angled side wall and base, and including a bottle tilting rod mechanism that can be locked into position by means of a slotted interface.
Figure 25:
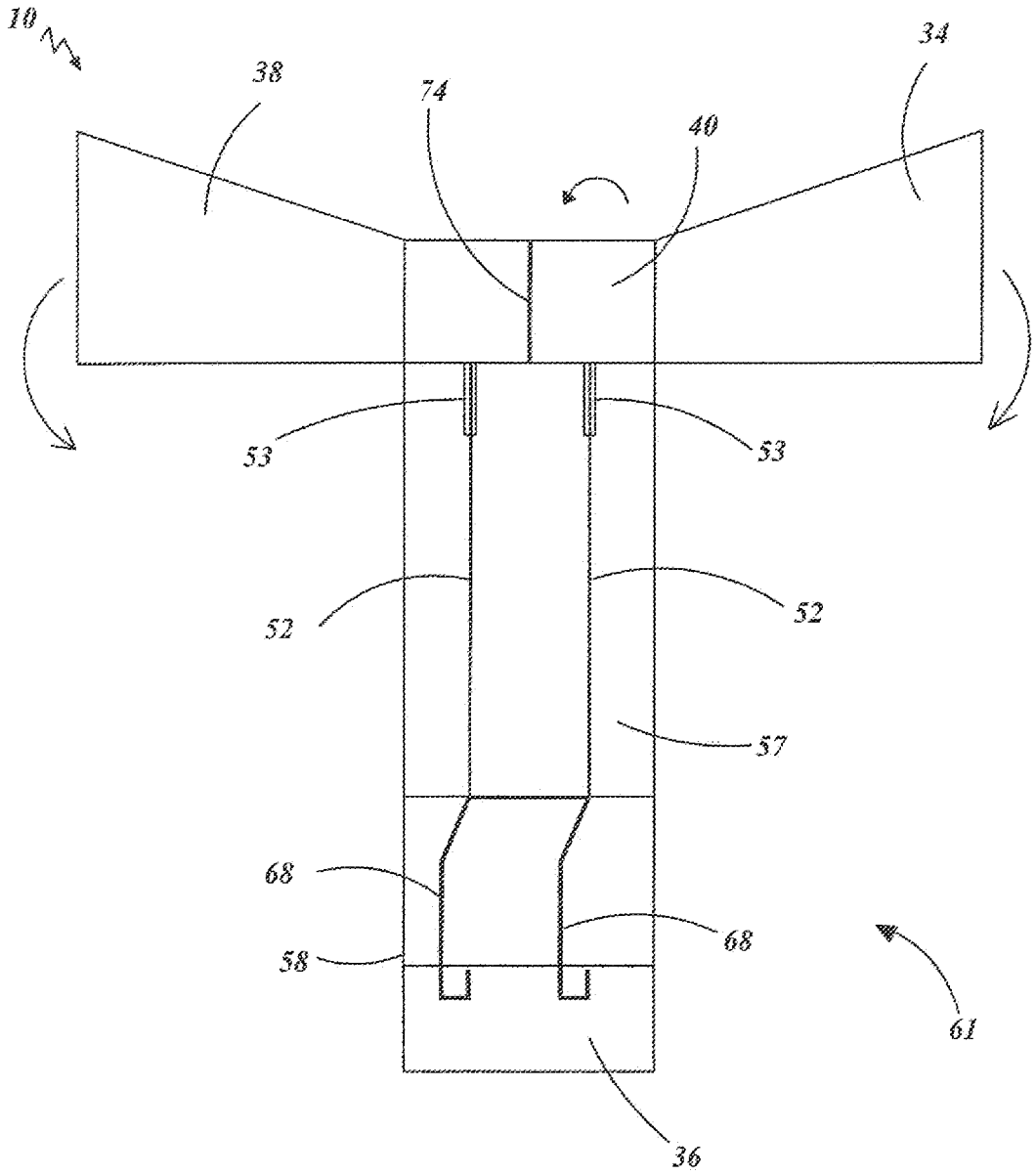
FIG. 25 is a net drawing showing the dual row inner bottle retainer as a unitary one-piece assembly that can be folded into the shape of the dual row inner bottle retainer with an angled side wall and base with an inner divider, and including a bottle tilting rod mechanism that can be locked into position by means of a slotted interface.

As shown in FIGS. 24 and 25 are two unitary one-piece assemblies 60 and 61 that can be folded into the shape of a single and dual row inner bottle retainer, with an angled side wall 58 having one or two slots 68, an angled base 57 having one or two short slots 53, a sliding rod 51 or U-shape sliding rod 52 that functions as a tilting mechanism. A divider 74 can be located between the two side walls, thereby creating two rows within the inner bottle retainer.

In the first cabinet 14 with slanted shelves is at least one single row inner bottle retainer 32 or at least one dual row 33 inner bottle retainer with bases 41 having sliding bars with smooth edges 72 integral, or bases 43 having a miter T-track 46 with a miter T-bar 70 having smooth edges 72 inserted into each base.

A plurality of bottles are stacked within each inner bottle retainer with the bottle's necks facing outward. The inner bottle retainers are placed on the slanted shelves within the first cabinet, which are dimensioned to accept the inner bottle retainer(s). When a bottle is removed from the tilted retainer, the bottle in the front of the stack is pulled outward, and gravity causes the remaining bottles to move (slide) forward.

Figure 19:
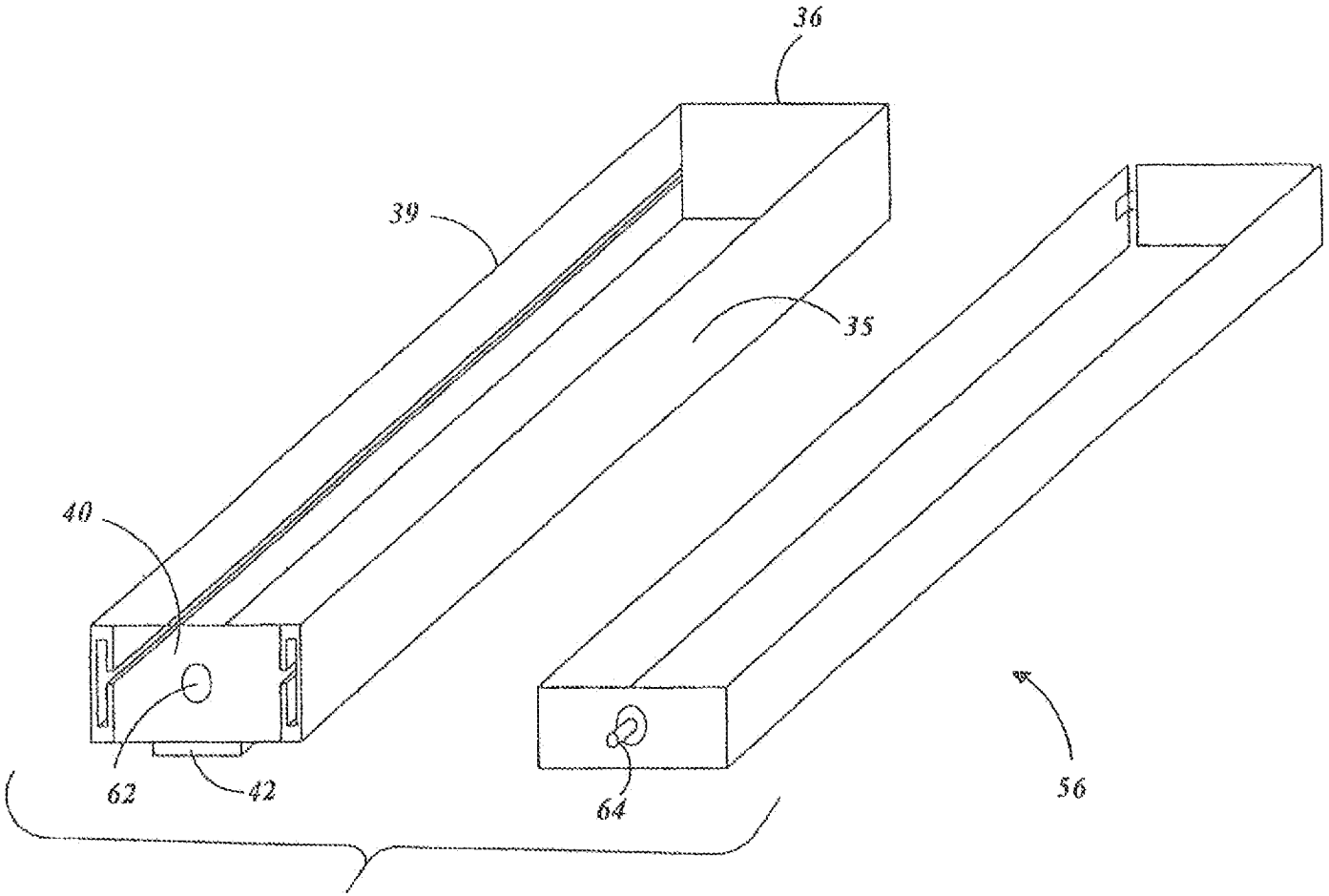
FIG. 19 is two orthographic views, the first view showing a single row inner botte retainer with two miter T-tracks in first and third side walls where a pushing or pulling assembly can be installed and a metal pad at the center of a fourth wide wall, the second orthographic view showing the pushing or pulling assembly that can be inserted into the first and third side walls miter T-tracks and a magnetic grip in the form of a knob in the front as a locking mechanism.
Figure 20:
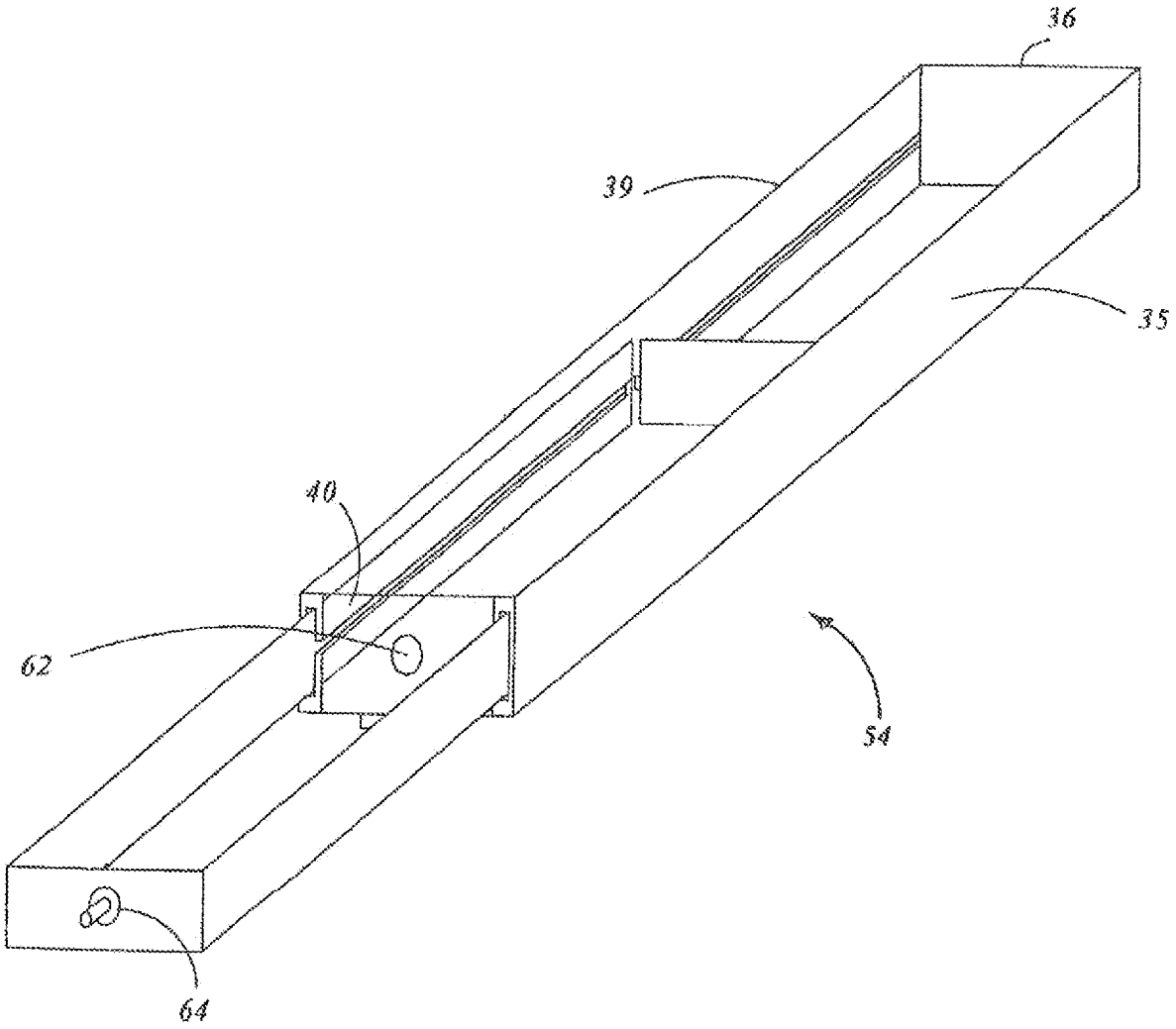
FIG. 20 is an orthographic view showing a single row inner bottle retainer with the pushing or pulling assembly installed, and a metal pad at the center of the fourth side wall, and a magnetic grip in the form of a knob as a locking mechanism.

As shown in FIGS. 19 and 20, a single row inner bottle retainer with a pushing or pulling assembly 54 has a first side wall 35 having a miter T-track, a second side wall 36, a third side wall 39 having a miter T-track, a fourth side wall 40 having a metal pad 62, and a sliding frame 56 having a magnetic grip 64 at the front end. The two retainer elements 56, as shown in FIG. 19, are combined together to create the single retainer element 54, as shown in FIG. 20.

Figure 21:
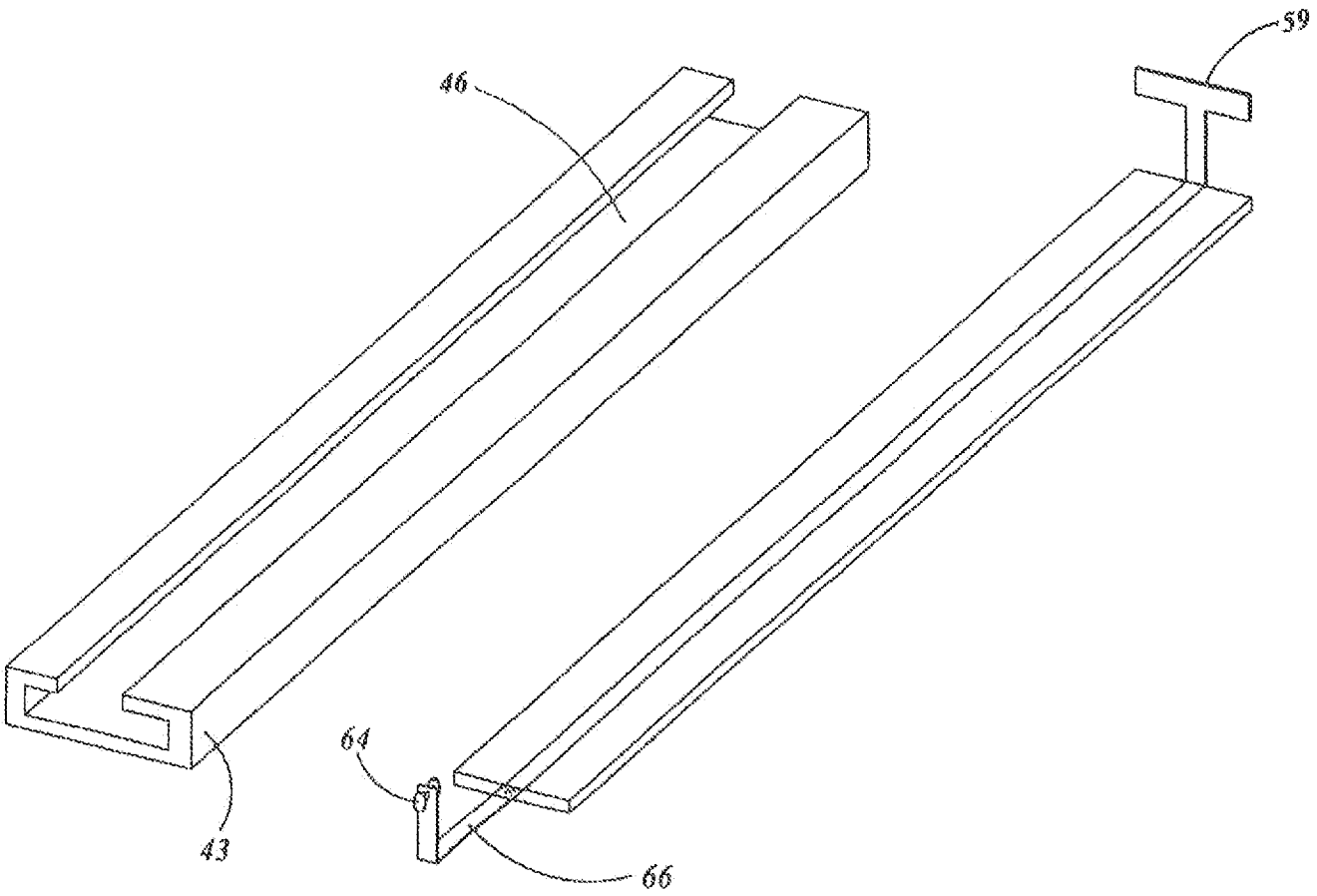
FIG. 21 is two orthographic views, the first view showing a single row inner botte retainer base with miter T-track, the second orthographic view showing the miter T-bar with the pushing or pulling assembly that can be inserted into the base miter T-track.
Figure 22:
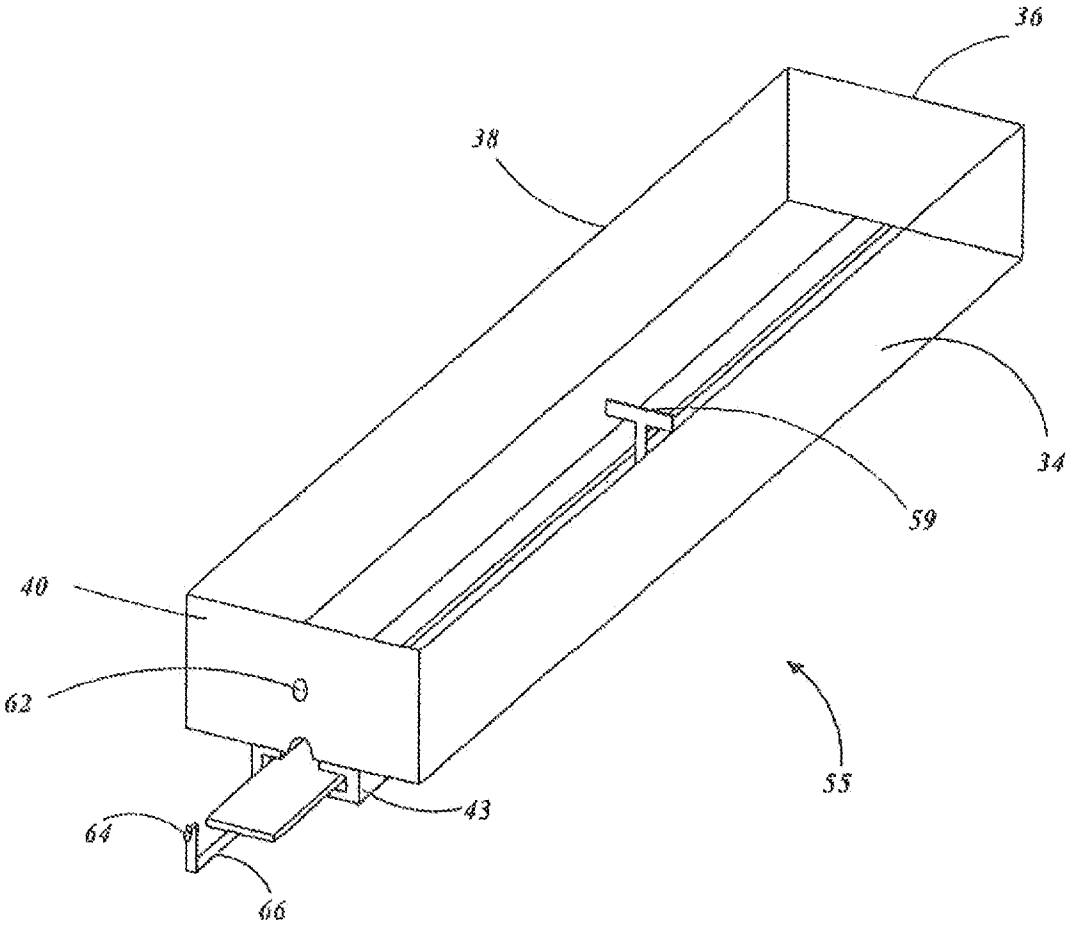
FIG. 22 is an orthographic view showing a single row inner bottle retainer with a miter T-bar inserted into the base miter T-track to function as pushing or pulling mechanism, the miter T-bar having a magnet in the front along with a knob as a locking mechanism and a metal pad at the center of a fourth side wall.

As shown in FIGS. 21 and 22, a single row inner bottle retainer with a pushing or pulling assembly 55 has a first side wall 34, a second side wall 36, a third side wall 38, a fourth side wall 40, a metal pad 62 and a base 43 having a meter T-track 46. Inserted into the base's miter T-track is a miter T-rod 66 having a magnetic grip 64 at the front end and an upward extending member 59 at the rear end. The miter T-rod 66 slides longitudinally along the base 43 from rear to front with the upward extending member 59 interfacing with a rearward item within the retainer 55. Thereby, when an item is removed from the retainer, the item in the front of the stack of items within the retainer is pulled outward. The miter T-rod 66 is manually pulled forward by the magnetic grip 64, so the rearward item and all items in front are pulled forward within the retainer. The two retainer elements, as shown in FIG. 21, are combined together to create the single retainer element, as shown in FIG. 22.

In the second cabinet 15 with horizontal shelves, are single row 32 or dual row 33 inner bottle retainers with bases 42 both without miter T-track and miter T-bars (sliding bars) or single or dual row inner bottle retainer with an angled side wall 28 and tilting sliding mechanism, or single row inner bottle retainer with the pushing or pulling assembly 54 or 55.

A plurality of bottles are stacked within each inner bottle retainer with the bottle's necks facing outward. The inner bottle retainer is placed on the horizontal shelves within the second cabinet, which are dimensioned to accept the inner bottle retainer(s). When an item is removed from the retainer, the item in the front of the stack of items is pulled outward, and the remaining items can be pulled forward manually, when using inner bottle retainers 32 and 33 with bases 42 without the sliding bar or miter T-bar, or by using the pushing or pulling assembly when using inner bottle retainers 54 and 55. When using the inner bottle retainer 28 with the tilting mechanism in the cabinet 15 or any other horizontal shelves, the mechanism allows items to be held in a tilted orientation. When the item in the front of the stack of items is pulled outward, gravity causes the remaining items to move (slide) forward.

Figure 5:
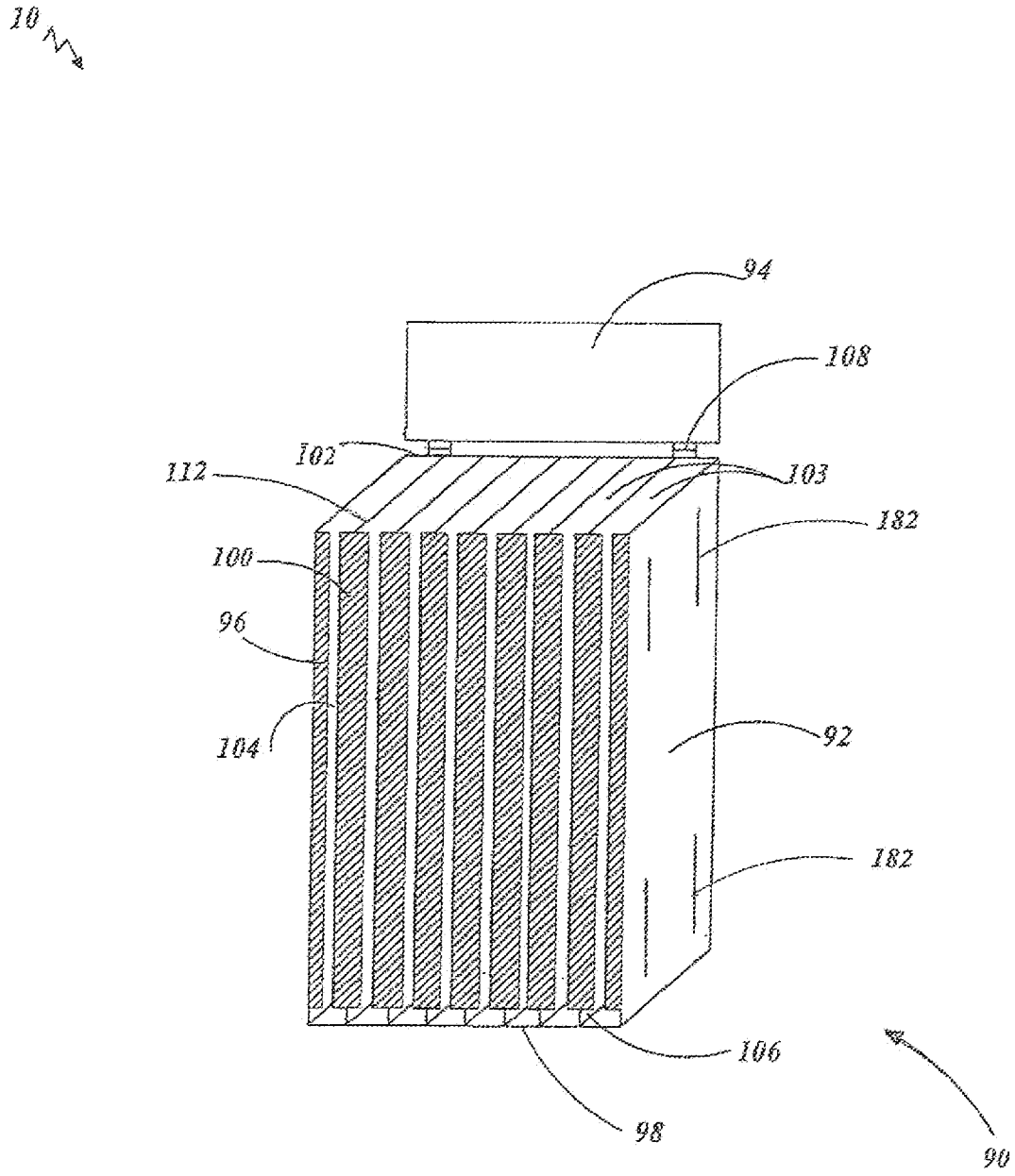
FIG. 5 is an orthographic view showing the MDSDS third cabinet.

A third cabinet 90, as shown in FIG. 5, is comprised of a first side wall 92, an upper side wall 94, a second side wall 96, a lower side wall 98, a front panel 100, a rear panel 102 and hinges 108. The hinges connect the upper side wall 94 with the rear panel 102, allowing the upper side wall 94 to be raised, thereby allowing access to the interior of the cabinet 90. The interior has dividers 112 that create at least one channel 103. The location and size of each channel corresponds to the location of one vertical slot 104. Items are place inside the cabinet through one channel's upper opening 103, one item at the time using the slot 104 to place the first item at the lower access opening 106. The rest of the items are stacked on top of each other to fill one channel. When an item is removed, the item at the bottom of the stack is pulled outward from the lower access opening 106, and gravity causes the remaining items to move downward.

Figure 6:
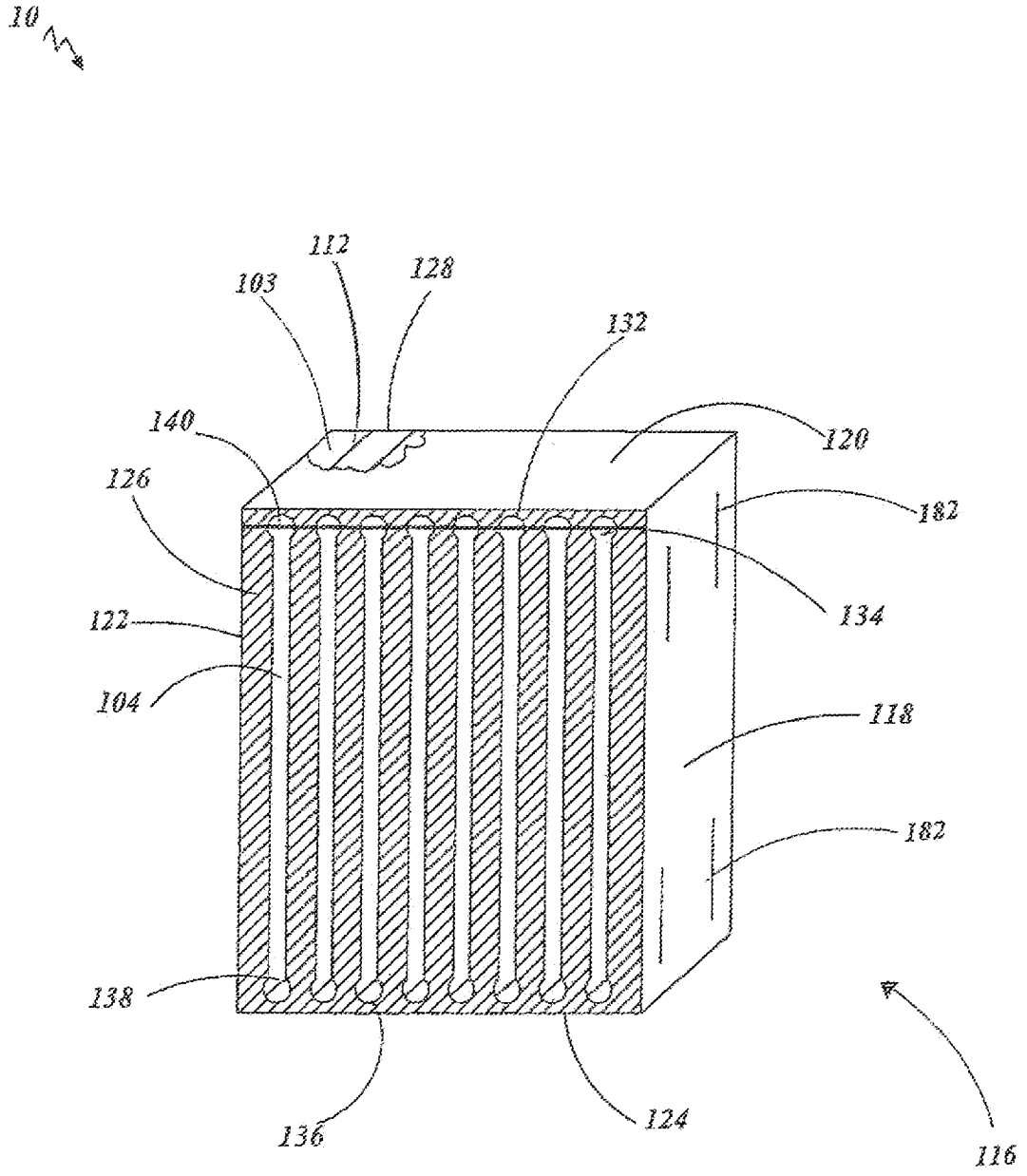
FIG. 6 is an orthographic view showing the MDSDS fourth cabinet.

A fourth cabinet 116, as shown in FIG. 6, is comprised of a first side wall 118, an upper side wall 120, a second side wall 122, a lower side wall 124, a front panel 126 and a rear panel 128. An interior opening between the rear panel 128 and the front panel 126 has dividers 112 that create at least one channel 103. The location and size of each channel corresponds to the location of one vertical slot 104 in the front panel 126 which is used to fill the channels. At the upper end 132 of each slot is an upper opening 134, and at the lower end 136 is a lower opening 138. The two openings 134, 138 are preferably circular, but other shapes could be also utilized. Bottles can be placed inside the cabinet by inserting them through the upper opening 134 one bottle at time using the slot 104 to place the first bottle at the lower opening 138. The rest of the bottles are stacked on top of each other to fill one channel. When a bottle is removed, the bottle at the bottom of the stack of bottles is pulled outward from the lower opening 138, and gravity causes the remaining bottles to move downward. To provide additional maintaining of the bottles within the cabinet, a securing rod 140 can extend across the cabinet, along the path of the upper openings 134. Once in place, the rod 140 makes it impossible for bottles to be inserted into or removed from the upper openings 134.

Figure 7:
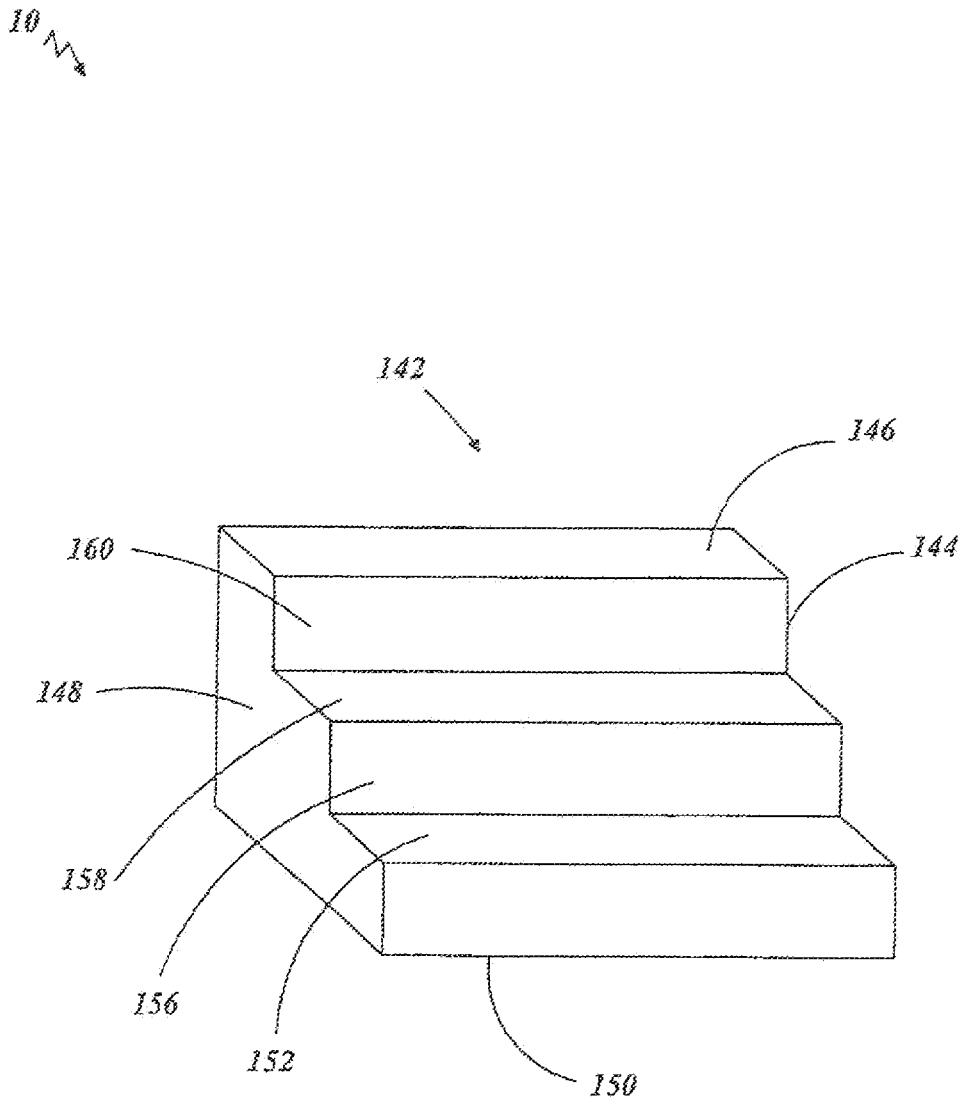
FIG. 7 is an orthographic view showing the MDSDS fifth tiered cabinet.

A fifth cabinet 142, which is the simplest designed cabinet, as shown in FIG. 7, deviates from the shared characteristics of the previous cabinets. The fifth cabinet 142 increases the functionality of the MDSDS 10 by providing a structure that can display items other than small bottles of liquor or tobacco items, such as candy, gun, energy drinks, vitamin bottles, medicine bottles, nail polish, small jars or cans of spices, air fresheners or other beverages, or even non-consumable items such as hygiene items, stationary etc. As the previous designs, the fifth cabinet 142 has a first side wall 144, an upper side wall 146, a second side wall 148, and a lower side wall 150. The fifth cabinet 142 has a multi-level design with at least two tiers. For the purpose of this disclosure, the fifth cabinet will have two tiers: a lower first tier with a horizontal surface 152, and a vertical surface 156 and a second tier with a horizontal surface 158 and a vertical surface 160. Preferably, the fifth cabinet is placed in front of the fourth cabinet facing the customers.

Figure 23:
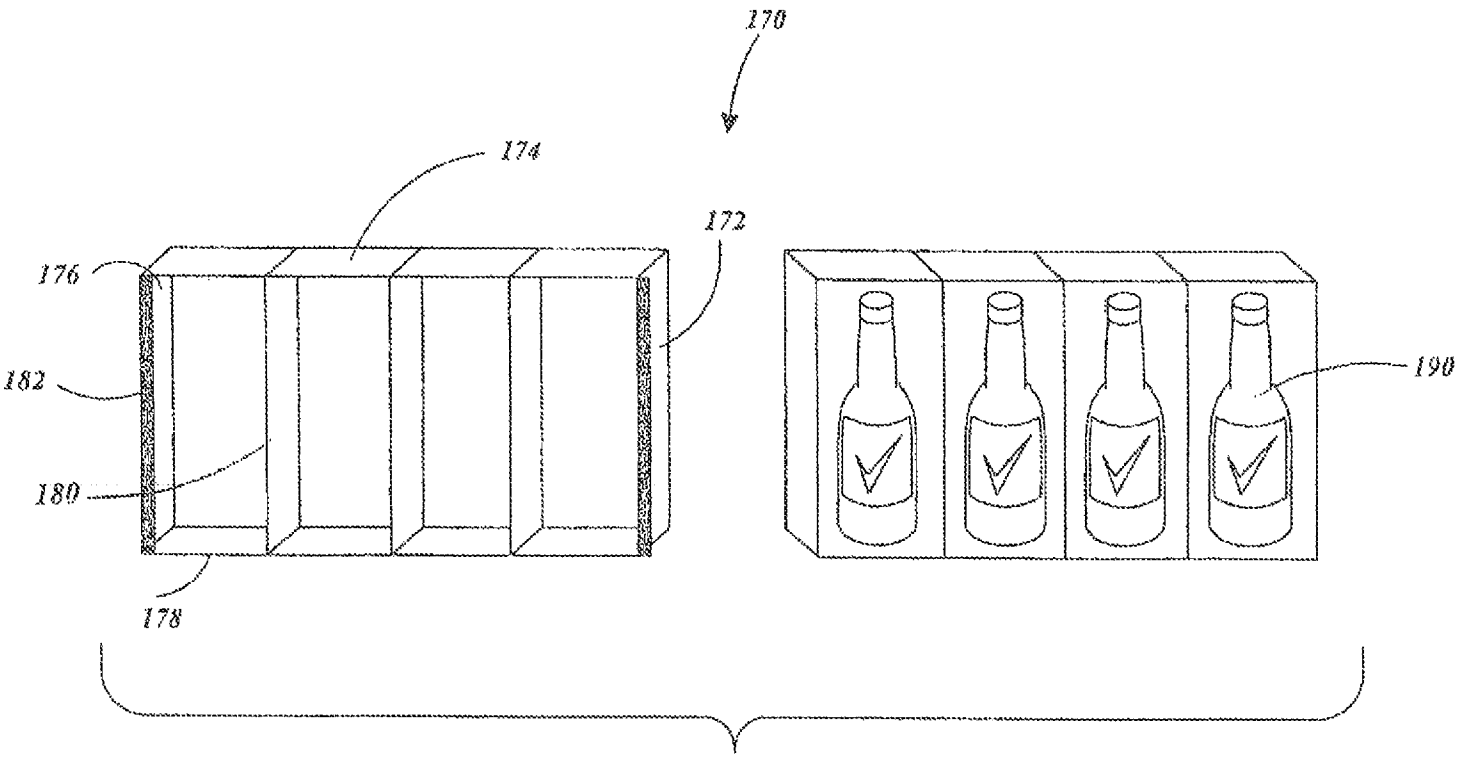
FIG. 23 is an orthographic view showing rear and front views of the display.

Lastly, a display cabinet 170, as shown in FIG. 23, can be utilized to just display item such as small liquor bottles. The display cabinet allows the bottles to be seen up-close by customers, and then retrieved by a store clerk from one of the other MDSDS 10 cabinets or another location such as a shelf behind the counter The display cabinet 170 follows the designs of the other cabinets and comprises a first side wall 172, an upper side wall 174, a second side wall 176, a lower side wall 178 and at least one space divider 180.

All of the cabinets and inner bottle retainers can be made of various materials including wood, plastic, acrylic, metal, fiberglass or a composite. When acrylic or plastic are used, the acrylic or plastic can be transparent, allowing a person to view the contents of the cabinet in any position. The inner bottle retainer can also be made of cardboard. When the inner bottle retainer is made of cardboard, it can be maintained in an open, flat configuration, as a unitary one-piece assembly, and then folded into shape for use, as shown in FIGS. 24 and 25.

Since the MDSDS 10 is modular, the types and number of cabinets can vary depending on the requirement of use. Multiple cabinets can simply be placed next to or on other cabinets. Preferably, multiple cabinets are maintained together as a unitary structure by cabinet securing means 182. As shown in FIGS. 3, 4, 5 and 6, the cabinet securing means 182 are located on the outside of the side walls. Other securing means can also be utilized including a hook and loop fastener, screws, bolts and nuts or/and adhesive. To assist in identifying merchandise 190 within the cabinets merchandise indicators that show the name/brand, price, and type of the item(s) within the cabinet(s) can be utilize. The indicators can comprise a LED display, a LCD display, a sticker or printing directly on the cabinet. Also, when the LED lights are present the light can be utilized to illuminate the items within the cabinets.

While the invention has been described in detail and pictorially shown in the accompanying drawings it is not to be limited to such details, since many changes and modification may be made to the invention without departing from the spirit and the scope thereof. Hence, it is described to cover any and all modifications and forms which may come within the language and scope of the claims.

The invention claimed is:

1. A merchandise displaying, storing and dispensing system comprising:

a modular structure comprised of:
- a first cabinet with:
  - a first side wall,
  - an upper side wall,
  - a second side wall,
  - a lower side wall,
  - a rear panel,
  - at least one slanted shelf,
  - at least one inner bottle retainer configured within the first cabinet and comprising:
    - a first side wall,
    - a second side wall,
    - a third side wall,
    - a fourth side wall
    - a base having a sliding bar,
- a second cabinet comprising,
  - a first side wall,
  - an upper side wall,
  - a second side wall,
  - a lower side wall,
  - a rear panel,
  - at least one horizontal shelf,
  - at least one inner bottle retainer configured within the second cabinet and comprising:
  - a first side wall,
  - a second side wall,
  - a third side wall,
  - a fourth side wall,
  - a base,
- a third cabinet comprising:
  - a first side wall,
  - an upper side wall,
  - a second side wall,
  - a lower side wall,
  - a rear panel,
  - a front panel having at least one vertical slot that extends to the upper surface and having a lower access opening, at least one hinge secured to the upper side wall and rear panel, allowing the upper side wall to be raised upward, at least one interior channel created by placing at least one vertical divider within the third cabinet, a fourth cabinet comprising:

a first side wall, an upper side wall, a second side wall, a lower side wall, a rear panel, a front panel having at least one vertical slot configured with an upper end that terminates with an upper opening, and a lower end that terminates with a lower opening, a fifth cabinet comprising:

a first side wall, an upper side wall, a second side wall, a lower side wall, at least two tiers, a display cabinet comprising:

a first side wall, an upper side wall, a second side wall, a lower side wall, cabinet securing means comprising:

a miter T-track, and a miter T-bar configured to be slidably inserted into the miter T-track and maintained therein.

2. The merchandise displaying, storing and dispensing system of claim 1, wherein the cabinets are made of a material selected from the group consisting of plastic, acrylic, fiberglass, wood, metal and a composite material.

3. The merchandise displaying, storing and dispensing system of claim 1, wherein the inner bottle retainer comprises an angled first side wall and angled second side wall that allows the inner bottle retainer to be configured with a front-facing downward tilt.

4. The merchandise displaying, storing and dispensing system of claim 1, wherein the modular structure is placed on or adjacent a counter in a retail establishment.

5. The merchandise displaying, storing and dispensing system of claim 1, wherein the modular structure is built into a counter during construction of a retail establishment.

6. The merchandise displaying, storing and dispensing system of claim 1, wherein the cabinet's front panels are configured to face forward or rearward.

7. The merchandise displaying, storing and dispensing system of claim 1, wherein the inner bottle retainer further comprising a pushing or pulling assembly having a sliding frame extending along the inner side walls of the inner bottle retainer and with a gripping member extending outward from a front end of the retainer, wherein the sliding frame encompasses items within the retainer and as the frame slides forward, a rear member of the frame interfaces with a most rearward item, thereby moving the rearward item and all items in front forward.

8. The merchandise displaying, storing and dispensing system of claim 7, wherein the pushing or pulling assembly further comprises a securing means comprising a metal pad on the fourth side wall of the inner bottle retainer and a corresponding magnet having a knob on the assembly, wherein when the pushing or pulling assembly is completely pushed inward within the retainer, the magnet and pad secure the assembly within the retainer.

9. The merchandise displaying, storing and dispensing system of claim 1, wherein the inner bottle retainer further comprising a pushing or pulling rod located within a slot on the bases T-track, wherein the rod slides longitudinally along the track from rear to front, interfacing with a rearward item within the retainer, thereby moving the rearward item and all items in front forward.

10. The merchandise displaying, storing and dispensing system of claim 9, wherein the pushing or pulling rod further comprises securing means comprising a metal pad on the fourth side wall of the inner bottle retainer and a corresponding magnet having a knob on a front end of the rod, wherein when the pushing or pulling rod is completely pushed inward within the retainer, the magnet and pad secure the rod within the retainer.

11. The merchandise displaying, storing and dispensing system of claim 1, wherein the display cabinet further comprising at least one vertical divider within the display cabinet, with each divider area displaying a single item.

12. The merchandise display, storing and dispensing system of claim 1, wherein the base comprising a sliding bar with a smooth edge.

13. The merchandise displaying, storing and dispensing system of claim 12, wherein the sliding bar is configured as a miter T-bar inserted into the base.

14. The merchandise displaying, storing and dispensing system of claim 12, wherein the sliding bar is configured integral with the base.

* * * * *